US011208732B2

(12) United States Patent
Huang et al.

(10) Patent No.: US 11,208,732 B2
(45) Date of Patent: Dec. 28, 2021

(54) MONITORING SURFACE OXIDE ON SEED LAYERS DURING ELECTROPLATING

(71) Applicant: Lam Research Corporation, Fremont, CA (US)

(72) Inventors: Ludan Huang, King City, OR (US); Lee J. Brogan, Newberg, OR (US); Tighe A. Spurlin, Portland, OR (US); Shantinath Ghongadi, Tigard, OR (US); Jonathan David Reid, Sherwood, OR (US); Manish Ranjan, Sherwood, OR (US); Bryan Pennington, Sherwood, OR (US); Clifford Raymond Berry, West Linn, OR (US)

(73) Assignee: Lam Research Corporation, Fremont, CA (US)

( * ) Notice: Subject to any disclaimer, the term of this patent is extended or adjusted under 35 U.S.C. 154(b) by 21 days.

(21) Appl. No.: 16/562,976

(22) Filed: Sep. 6, 2019

(65) Prior Publication Data

US 2019/0390361 A1 Dec. 26, 2019

Related U.S. Application Data

(62) Division of application No. 15/475,022, filed on Mar. 30, 2017, now Pat. No. 10,443,146.

(51) Int. Cl.

| | |
|---|---|
| ***C25D 21/12*** | (2006.01) |
| ***C25D 7/12*** | (2006.01) |
| ***C25D 5/34*** | (2006.01) |

(52) U.S. Cl.

CPC ..... *C25D 21/12* (2013.01); *C25D 5/34* (2013.01); *C25D 7/123* (2013.01)

(58) Field of Classification Search

CPC ..... C25D 7/123; C25D 5/34

See application file for complete search history.

(56) References Cited

U.S. PATENT DOCUMENTS

| | | | |
|---|---|---|---|
| 4,495,558 | A | 1/1985 | Cath et al. |
| 4,551,357 | A | 11/1985 | Takeuchi |

(Continued)

FOREIGN PATENT DOCUMENTS

| | | | |
|---|---|---|---|
| CN | 1639859 | A | 7/2005 |
| CN | 100350545 | C | 11/2007 |

(Continued)

OTHER PUBLICATIONS

U.S. Office Action, dated Dec. 9, 2014, issued in U.S. Appl. No. 13/741,151.

(Continued)

*Primary Examiner* — Brian W Cohen

(74) *Attorney, Agent, or Firm* — Weaver Austin Villeneuve & Sampson LLP

(57) ABSTRACT

Methods and apparatus for determining whether a substrate includes an unacceptably high amount of oxide on its surface are described. The substrate is typically a substrate that is to be electroplated. The determination may be made directly in an electroplating apparatus, during an initial portion of an electroplating process. The determination may involve immersing the substrate in electrolyte with a particular applied voltage or applied current provided during or soon after immersion, and recording a current response or voltage response over this same timeframe. The applied current or applied voltage may be zero or non-zero. By comparing the current response or voltage response to a threshold current, threshold voltage, or threshold time, it can be determined whether the substrate included an unacceptably high amount of oxide on its surface. The threshold current, threshold voltage, and/or threshold time may be selected based on a calibration procedure.

8 Claims, 8 Drawing Sheets

(56) References Cited

U.S. PATENT DOCUMENTS 4,642,161 A 2/1987 Akahoshi et al.
4,902,551 A 2/1990 Nakaso et al.
4,904,621 A 2/1990 Loewenstein et al.
5,252,196 A 10/1993 Sonnenberg et al.
5,472,563 A 12/1995 Kogawa et al.
6,056,850 A 5/2000 Blalock et al.
6,086,956 A 7/2000 Fakler et al.
6,107,192 A 8/2000 Subrahmanyan et al.
6,123,775 A 9/2000 Hao et al.
6,126,798 A 10/2000 Reid et al.
6,156,167 A 12/2000 Patton et al.
6,197,181 B1 3/2001 Chen
6,204,192 B1 3/2001 Zhao et al.
6,232,230 B1 5/2001 Iacoponi
6,255,217 B1 7/2001 Agnello et al.
6,319,384 B1 11/2001 Taylor et al.
6,352,938 B2 3/2002 Chen et al.
6,432,821 B1 8/2002 Dubin et al.
6,440,291 B1 8/2002 Henri et al.
6,464,779 B1 10/2002 Powell et al.
6,569,299 B1 5/2003 Reid et al.
6,573,607 B2 6/2003 Ito et al.
6,602,653 B1 8/2003 Geusic et al.
6,610,192 B1 8/2003 Step et al.
6,638,411 B1 10/2003 Mishima et al.
6,664,122 B1 12/2003 Andryuschenko et al.
6,680,540 B2 1/2004 Nakano et al.
6,699,380 B1 3/2004 Chen et al.
6,709,523 B1 3/2004 Toshima et al.
6,720,204 B2 4/2004 Sudijono et al.
6,734,102 B2 5/2004 Rathi et al.
6,743,719 B1 6/2004 Chen et al.
6,764,952 B1 7/2004 Yu et al.
6,793,796 B2 9/2004 Reid et al.
6,800,187 B1 10/2004 Reid et al.
6,815,349 B1 11/2004 Minshall et al.
6,844,258 B1 1/2005 Fair et al.
6,849,122 B1 2/2005 Fair
6,902,605 B2 6/2005 Kolics et al.
6,946,401 B2 9/2005 Huang et al.
6,962,873 B1 11/2005 Park
7,204,639 B1 4/2007 Gotkis et al.
7,232,513 B1 6/2007 Webb et al.
7,265,061 B1 9/2007 Cho et al.
7,270,734 B1 * 9/2007 Schetty, III ..... C25D 5/10 205/118
7,327,948 B1 2/2008 Shrinivasan et al.
7,405,157 B1 7/2008 Reid et al.
7,442,267 B1 10/2008 Webb et al.
7,456,102 B1 11/2008 Varadarajan et al.
7,534,298 B2 5/2009 Shanmugasundram et al.
7,799,684 B1 9/2010 Reid et al.
7,851,232 B2 12/2010 Van Schravendijk et al.
7,874,218 B2 1/2011 Izumi et al.
7,879,218 B1 2/2011 Webb et al.
7,897,198 B1 3/2011 Parks et al.
7,941,039 B1 5/2011 Shrinivasan et al.
7,964,506 B1 6/2011 Ponnuswamy et al.
8,033,771 B1 10/2011 Gage et al.
8,043,958 B1 10/2011 Reid et al.
8,084,339 B2 12/2011 Antonelli et al.
8,084,399 B2 12/2011 Yu et al.
8,137,465 B1 3/2012 Shrinivasan et al.
8,137,467 B2 3/2012 Meinhold et al.
8,197,662 B1 6/2012 Webb et al.
8,217,513 B2 7/2012 Antonelli et al.
8,242,028 B1 8/2012 Van Schravendijk et al.
8,288,288 B1 10/2012 Gage et al.
8,371,567 B2 2/2013 Angelov et al.
8,372,754 B2 2/2013 Hanson et al.
9,070,750 B2 6/2015 Spurlin et al.
9,469,912 B2 10/2016 Buckalew et al.
9,472,377 B2 10/2016 Opocensky et al.
9,607,822 B2 3/2017 Buckalew et al.
9,865,501 B2 1/2018 Spurlin et al.
10,443,146 B2 10/2019 Huang et al.
2001/0013473 A1 8/2001 Taylor
2001/0014373 A1 8/2001 Lin et al.
2001/0015321 A1 8/2001 Reid et al.
2001/0024769 A1 9/2001 Donoghue et al.
2002/0008034 A1 1/2002 Chen et al.
2002/0064944 A1 5/2002 Chung et al.
2002/0074242 A1 6/2002 Morrissey et al.
2002/0134684 A1 9/2002 Calvert et al.
2002/0195352 A1 12/2002 Mayer et al.
2003/0001271 A1 1/2003 Uozumi
2003/0017628 A1 1/2003 Li et al.
2003/0034251 A1 2/2003 Chikarmane et al.
2003/0036280 A1 2/2003 Jain et al.
2003/0051665 A1 3/2003 Zhao et al.
2003/0110833 A1 6/2003 Jolic
2003/0186524 A1 10/2003 Ryo
2003/0213561 A1 11/2003 Selwyn et al.
2004/0000488 A1 1/2004 Yang
2004/0050685 A1 3/2004 Yara et al.
2004/0069651 A1 4/2004 Herchen et al.
2004/0072440 A1 4/2004 Kim et al.
2004/0084301 A1 5/2004 Dordi et al.
2004/0118697 A1 6/2004 Wen+ et al.
2004/0142557 A1 7/2004 Levy et al.
2004/0200244 A1 10/2004 Hong et al.
2004/0217009 A1 11/2004 Mikkola et al.
2004/0226827 A1 11/2004 Matsuda et al.
2005/0006245 A1 1/2005 Sun et al.
2005/0020057 A1 1/2005 Kudo et al.
2005/0085090 A1 4/2005 Mui et al.
2005/0112856 A1 5/2005 Dubin et al.
2005/0167404 A1 8/2005 Yamazaki
2005/0186793 A1 8/2005 Omoto et al.
2005/0208754 A1 9/2005 Kostamo et al.
2005/0239286 A1 10/2005 Wu et al.
2006/0223310 A1 10/2006 Suzuki
2006/0278612 A1 12/2006 Tokunaga et al.
2006/0283716 A1 12/2006 Hafezi et al.
2007/0048447 A1 3/2007 Lee et al.
2007/0062818 A1 3/2007 Daviot et al.
2007/0292603 A1 12/2007 Dordi et al.
2008/0020593 A1 1/2008 Wang et al.
2008/0081464 A1 4/2008 Matsuda et al.
2008/0124932 A1 5/2008 Tateishi et al.
2008/0152822 A1 6/2008 Vaskelis et al.
2008/0213994 A1 9/2008 Chebiam et al.
2009/0053426 A1 2/2009 Lu et al.
2009/0095220 A1 4/2009 Meinhold et al.
2009/0181164 A1 7/2009 Wang et al.
2009/0250350 A1 10/2009 Wei et al.
2009/0277867 A1 11/2009 Mayer et al.
2009/0291547 A1 11/2009 Schraub et al.
2010/0108491 A1 5/2010 Yoon et al.
2010/0200412 A1 8/2010 Reid et al.
2010/0317178 A1 12/2010 Antonelli et al.
2010/0317198 A1 12/2010 Antonelli et al.
2010/0320081 A1 12/2010 Mayer et al.
2011/0146571 A1 6/2011 Bartlett et al.
2012/0115303 A1 5/2012 Gambino et al.
2012/0211473 A1 8/2012 Goto et al.
2013/0171833 A1 7/2013 Buckalew et al.
2014/0199497 A1 7/2014 Spurlin et al.
2014/0209471 A1 7/2014 Rubin et al.
2014/0256127 A1 9/2014 Spurlin et al.
2014/0256128 A1 9/2014 Spurlin et al.
2014/0357089 A1 12/2014 Buckalew et al.
2015/0072538 A1 3/2015 Spurlin et al.
2015/0218724 A1 8/2015 Mevellec et al.
2015/0299886 A1 10/2015 Doubina et al.
2015/0303065 A1 10/2015 Buckalew et al.
2015/0376792 A1 12/2015 Spurlin et al.
2016/0111342 A1 4/2016 Huang et al.
2016/0111344 A1 4/2016 Opocensky et al.
2017/0011906 A1 1/2017 Buckalew et al.

(56) References Cited

U.S. PATENT DOCUMENTS

| | | | |
|---|---|---|---|
| 2018/0282894 | A1 | 10/2018 | Huang et al. |
| 2018/0350670 | A1 | 12/2018 | Spurlin et al. |

FOREIGN PATENT DOCUMENTS

| | | | |
|---|---|---|---|
| CN | 100399541 | C | 7/2008 |
| CN | 101730929 | A | 6/2010 |
| CN | 102804338 | A | 11/2012 |
| JP | 2000-183160 | A | 6/2000 |
| JP | 2000-208627 | A | 7/2000 |
| JP | 2001-40480 | A | 2/2001 |
| JP | 2002-004048 | A | 1/2002 |
| JP | 2002-222861 | A | 8/2002 |
| JP | 2007-528932 | A | 10/2007 |
| JP | 2009-507135 | A | 2/2009 |
| JP | 2009-224808 | A | 10/2009 |
| JP | 2010-503210 | A | 1/2010 |
| JP | 2012-501543 | A | 1/2012 |
| JP | 2012-516065 | A | 7/2012 |
| JP | 2012-174845 | A | 9/2012 |
| KR | 2002-0040445 | | 5/2002 |
| TW | 430867 | B | 4/2001 |
| TW | 200305254 | A | 10/2003 |
| TW | 589405 | | 6/2004 |
| TW | 200718810 | A | 5/2007 |
| TW | 200931534 | A | 7/2009 |
| WO | WO 2008/027386 | | 3/2008 |
| WO | WO 2010/025068 | | 3/2010 |
| WO | WO 2010/084759 | | 7/2010 |
| WO | WO 2014/014907 | | 1/2014 |
| WO | WO 2014/044942 | | 3/2014 |
| WO | WO 2015/152003 | | 10/2015 |

OTHER PUBLICATIONS

U.S. Office Action, dated Jul. 18, 2014, issued in U.S. Appl. No. 13/787,499.
U.S. Notice of Allowance, dated Feb. 6, 2015, issued in U.S. Appl. No. 13/787,499.
U.S. Office Action, dated May 6, 2015, issued in U.S. Appl. No. 14/020,339.
U.S. Final Office Action, dated Apr. 5, 2017, issued in Application No. 14/020,339.
U.S. Office Action, dated Dec. 3, 2014, issued in U.S. Appl. No. 14/086,770.
U.S. Final Office Action, dated May 20, 2015, issued in U.S. Appl. No. 14/086,770.
U.S. Office Action, dated Oct. 23, 2015, issued in U.S. Appl. No. 14/086,770.
U.S. Final Office Action, dated Apr. 22, 2016, issued in U.S. Appl. No. 14/086,770.
U.S. Office Action, dated Nov. 29, 2016, issued in U.S. Appl. No. 14/086,770.
U.S. Final Office Action, dated Apr. 19, 2017, issued in U.S. Appl. No. 14/086,770.
U.S. Notice of Allowance, dated Sep. 25, 2017, issued in U.S. Appl. No. 14/086,770.
U.S. Office Action, dated Apr. 2, 2019, issued in U.S. Appl. No. 15/828,286.
U.S. Notice of Allowance, dated Jun. 21, 2016, issued in U.S. Appl. No. 14/257,744.
U.S. Notice of Allowance, dated Nov. 23, 2016, issued in U.S. Appl. No. 15/264,262.
U.S. Office Action, dated Feb. 5, 2016, issued in U.S. Appl. No. 14/256,671.
U.S. Final Office Action, dated May 19, 2016, issued in U.S. Appl. No. 14/256,671.
U.S. Office Action, dated Aug. 25, 2016, issued in U.S. Appl. No. 14/256,671.
U.S. Office Action, dated Feb. 2, 2016, issued in U.S. Appl. No. 14/320,171.
U.S. Office Action dated Mar. 9, 2016, issued in U.S. Appl. No. 14/657,956.
U.S. Notice of Allowance dated Jun. 22, 2016, issued in U.S. Appl. No. 14/657,956.
U.S. Office Action dated Jan. 13, 2017, issued in U.S. Appl. No. 14/884,504.
U.S. Final Office Action dated May 23, 2017, issued in U.S. Appl. No. 14/884,504.
U.S. Office action dated Jan. 3, 2019, issued in U.S. Appl. No. 15/475,022.
U.S. Notice of Allowance dated Jun. 18, 2019, issued in U.S. Appl. No. 15/475,022.
U.S. Office Action, dated Oct. 18, 2005, issued in U.S. Appl. No. 10/741,048.
U.S. Office Action, dated Mar. 9, 2006, issued in U.S. Appl. No. 10/741,048.
U.S. Office Action, dated Mar. 17, 2006, issued in U.S. Appl. No. 10/741,048.
U.S. Final Office Action, dated Jul. 18, 2006, issued in U.S. Appl. No. 10/741,048.
U.S. Office Action, dated Nov. 27, 2006, issued in U.S. Appl. No. 10/741,048.
U.S. Final Office Action, dated Apr. 24, 2007, issued in U.S. Appl. No. 10/741,048.
U.S. Office Action, dated Aug. 9, 2007, issued in U.S. Appl. No. 10/741,048.
U.S. Final Office Action, dated Dec. 14, 2007, issued in U.S. Appl. No. 10/741,048.
US Examiner's Answer Before the Board of Patent Appeals and Interferences, dated Jun. 18, 2008, issued in U.S. Appl. No. 10/741,048.
US Examiner's Decision on Appeal Before the Board of Patent Appeals and Interferences, dated Sep. 17, 2010, issued in U.S. Appl. No. 10/741,048.
U.S. Notice of Allowance, dated Sep. 23, 2010, issued in U.S. Appl. No. 10/741,048.
U.S. Notice of Allowance, dated Feb. 23, 2012, issued in U.S. Appl. No. 12/971,367.
Chinese First Office Action, dated Apr. 1, 2016, issued in Application No. CN 201410080405.0.
Chinese Second Office Action, dated Dec. 5, 2016, issued in Application No. CN 201410080405.0.
Chinese Third Office Action, dated Jun. 2, 2017, issued in Application No. CN 201410080405.0.
Chinese Rejection of Rejection Decision dated Dec. 4, 2017, issued in Application No. CN 201410080405.0.
Chinese Fourth Office Action, dated Jun. 12, 2018, issued in Application No. CN 201410080405.0.
Taiwan Examination Report, dated Jun. 22, 2017, issued in Application No. TW 103107265.
Japanese First Office Action, dated Dec. 12, 2017, issued in Application No. JP 2014-042486.
Japanese First Office Action, dated Jul. 2, 2019, issued in Application No. JP 2018-152800.
Taiwan Notice of Allowance, dated Dec. 17, 2018, issued in Application No. TW 104112637.
International Search Report and Written Opinion, dated Jul. 17, 2018, issued in Application No. PCT/US18/25265.
Chavez et al., (2001) "A Novel Method of Etching Copper Oxide Using Acetic Acid" *Journal of the Electrochemical Society*, 148(11):G640-G643.
Shivkumar et al., (2016) "Analysis of Hydrogen Plasma in a Microwave Plasma Chemical Vapor Deposition Reactor," *J. Applied Phys.*, 119:1113301-1-13.
Venkataraman, (Aug. 2007) "Electrodeposition of Copper on Ruthenium Oxides and Bimetallic Corrosion of Copper/Ruthenium in Polyphenolic Antioxidants," *Thesis Prepared for the Degree of Master of Science*,University North Texas, 118 pages.
U.S. Appl. No. 13/493,933, filed Jun. 11, 2012, Webb et al.
U.S. Appl. No. 13/546,146, filed Jul. 11, 2012, Webb et al.
U.S. Office Action, dated May 1, 2013, issued in U.S. Appl. No. 13/493,933.

(56) References Cited

OTHER PUBLICATIONS

U.S. Office Action, dated Aug. 13, 2015, issued in U.S. Appl. No. 13/546,146.
U.S. Final Office Action, dated Feb. 26, 2016, issued in U.S. Appl. No. 13/546,146.
Chinese First Office Action, dated Jan. 5, 2021, issued in Application No. CN 201811642020.3.
Japanese Decision to Grant a Patent, dated Feb. 25, 2020, issued in Application No. JP 2018-152800.
Korean First Office Action, dated Aug. 26, 2020, issued in Application No. KR 10-2014-0026592.
International Preliminary Report on Patentability, dated Oct. 10, 2019, issued in Application No. PCT/US18/25265.
Taiwanese First Office Action, dated Jan. 6, 2020, issued in Application No. TW 104133943.
Korean First Office Action [No Translation] dated Jul. 1, 2021, issued in Application No. KR 10-2021-0056899.
Korean First Office Action dated Jun. 21, 2021, issued in Application No. KR 10-2015-0056215.
TW Office Action dated Aug. 4, 2021 issued in Application No. 107110880.

* cited by examiner

MONITORING SURFACE OXIDE ON SEED LAYERS DURING ELECTROPLATING

INCORPORATION BY REFERENCE

An Application Data Sheet is filed concurrently with this specification as part of the present application. Each application that the present application claims benefit of or priority to as identified in the concurrently filed Application Data Sheet is incorporated by reference herein in its entirety and for all purposes.

BACKGROUND

Feature sizes continue to shrink with the advancement of semiconductor processing technology. Similarly, metal seed layers continue to get thinner. These changes make it increasingly difficult to electroplate metal in semiconductor processing.

SUMMARY

Various embodiments herein relate to methods and apparatus for determining whether a substrate includes an unacceptably high amount of oxide on a surface of the substrate. The amount of oxide that is acceptable may depend on the particular application, for example depending on the geometry of the features, the composition of the electrolyte, the current and/or voltage used to electroplate metal onto the substrate, and other factors. The techniques described herein generally involve monitoring the current and/or voltage response during or shortly after the substrate is immersed in electrolyte. These responses can be analyzed to determine whether oxide was/is present on the surface of the substrate. Also described herein are methods for selecting pre-treatment conditions for removing oxide from a substrate surface.

In one aspect of the disclosed embodiments, a method of determining whether a substrate includes an unacceptably high amount of oxide on a surface of the substrate is provided, the method including: (a) receiving the substrate in an electroplating chamber; (b) immersing the substrate in electrolyte, where during and/or immediately after immersing the substrate, either: (i) a current applied to the substrate is controlled, or (ii) a voltage applied between the substrate and a reference is controlled; (c) measuring either a voltage response or a current response during and/or immediately after immersion, where: (i) the voltage response is measured if the current applied to the substrate is controlled in (b)(i), or (ii) the current response is measured if the voltage applied to the substrate is controlled in (b)(ii); (d) comparing the voltage response or current response measured in (c) to a threshold voltage, a threshold current, or a threshold time, where the threshold voltage, threshold current, or threshold time is selected to distinguish between (1) cases where the substrate includes the unacceptably high amount of oxide present on the surface of the substrate and (2) cases where the substrate includes an acceptably low amount of oxide present on the surface or no oxide present on the surface of the substrate; and (e) determining, based on the comparison in (d), whether the substrate includes the unacceptably high amount of oxide on the surface of the substrate.

In some embodiments, during (b) the current applied to the substrate is controlled, and during (c) the voltage response is measured. In some such embodiments, during (b), the current applied to the substrate is controlled at a non-zero current. In some other embodiments, during (b) the current applied to the substrate is controlled at a level of zero current, and during (c) the voltage response is measured, where the voltage response is an open circuit voltage response. In certain implementations, during (b) the voltage applied between the substrate and the reference is controlled, and during (c) the current response is measured. The reference may be an anode or a reference electrode, for instance.

In various embodiments, the threshold current, threshold voltage, and/or threshold time is selected based on a calibration procedure. In one example, the calibration procedure includes: (f) pre-treating a plurality of calibration substrates, each calibration substrate being pre-treated using a different set of pre-treatment conditions; (g) immersing each calibration substrate in electrolyte; (h) measuring a voltage response or a current response during and/or immediately after each calibration substrate is immersed in electrolyte; and (i) analyzing the voltage responses or current responses to identify the threshold current, threshold voltage, and/or threshold time. In some embodiments, at least one calibration substrate includes oxide on the surface of the substrate in an unacceptably high amount, and at least one calibration substrate includes either (1) oxide on the surface of the substrate at an acceptably low amount, or (2) no oxide on the surface of the substrate.

Various techniques can be used to compare the voltage or current response to the threshold voltage, threshold current, or threshold time. In one example, the voltage response or current response measured in (c) are measured at a target time. In another example, the method further includes analyzing the voltage response or current response measured in (c) to determine a time at which the voltage response or current response reach a target voltage or a target current, respectively, and (d) includes comparing the time at which the voltage response or current response reaches the target voltage or target current, respectively, to the threshold time. In another example, the method further includes determining a maximum voltage response or a maximum current response measured in (c), where the threshold voltage or threshold current correspond to a threshold maximum voltage or a threshold maximum current, respectively, and (d) includes comparing the maximum voltage response to the threshold maximum voltage or comparing the maximum current response to the threshold maximum current. In another example, the method further includes determining an integrated voltage response or an integrated current response by integrating the voltage response or current response measured in (c) over a target timeframe, where the threshold voltage or threshold current correspond to a threshold integrated voltage or a threshold integrated current, respectively, and (d) includes comparing the integrated voltage response to the threshold integrated voltage or comparing the integrated current response to the threshold integrated current.

In another aspect of the disclosed embodiments, a method of selecting pre-treatment conditions for removing oxide from a surface of a production substrate is provided, the method including: (a) providing a plurality of calibration substrates; (b) pre-treating at least some of the calibration substrates to at least partially remove oxide from a surface of each calibration substrate that is pre-treated, where the calibration substrates that are pre-treated are pre-treated using different sets of pre-treatment conditions; (c) immersing each calibration substrate in electrolyte; (d) measuring a voltage response or a current response during and/or immediately after each calibration substrate is immersed in electrolyte; (e) analyzing the voltage responses or current responses measured in (d) to identify which sets of pretreatment conditions resulted in adequate removal of oxide from the surface of a relevant calibration substrate; and (f) selecting pre-treatment conditions for removing oxide from the surface of a production substrate based on the analysis of (e).

In certain implementations, at least one calibration substrate is not pre-treated. In these or other implementations, at least one calibration substrate includes an oxide layer purposely deposited thereon. In one example, at least one calibration substrate is not pre-treated, and at least one calibration substrate is pre-treated to completely remove the oxide from its surface.

In some embodiments, the method further includes electroplating the production substrate. The production substrate may be electroplated using conditions that do not substantially vary from the conditions used to electroplate on the calibration substrates. For instance, in some such embodiments, a composition of the electrolyte in which each calibration substrate is immersed does not substantially vary from a composition of an electrolyte in which the production substrate is electroplated, a diameter of the calibration substrates does not substantially vary from a diameter of the production substrate, a composition of a seed layer on the calibration substrates does not substantially vary from a composition of a seed layer on the production substrate, a thickness of the seed layer on the calibration substrates does not substantially vary from a thickness of the seed layer on the production substrate, a magnitude of a current and/or voltage applied to the calibration substrates during and/or shortly after immersion, if any, does not substantially vary from a magnitude of a current and/or voltage applied to the production substrate during and/or shortly after immersion, if any, a vertical speed of immersion used to immerse the calibration substrates does not substantially vary from a vertical speed of immersion used to immerse the production substrate, a tilt angle and tilt speed used to immerse the calibration substrates does not substantially vary from a tilt angle and tilt speed used to immerse the production substrate, and a rate of rotation used to spin the calibration substrates during immersion does not substantially vary from a rate of rotation used to spin the production substrate during immersion. In some embodiments, the method further includes before electroplating the production substrate, pre-treating the production substrate using the pre-treatment conditions selected in (f).

In certain implementations, during (c) the current applied to each calibration substrate is controlled, and during (d) the voltage response is measured. In some such cases, during (c) the current applied to each calibration substrate is controlled at zero current, and the voltage response measured during (d) is an open circuit voltage response. In some other embodiments, during (c) the voltage applied to each calibration substrate is controlled, and during (d) the current response is measured.

In another aspect of the disclosed embodiments, an electroplating apparatus configured to determine whether a substrate includes an unacceptably high amount of oxide on a surface of the substrate is provided, the apparatus including: an electroplating chamber configured to hold electrolyte; a power supply configured to (1) apply current and/or voltage to the substrate and (2) measure a voltage response and/or current response in response to the applied current and/or applied voltage; a controller including executable instructions for: (a) receiving the substrate in an electroplating chamber; (b) immersing the substrate in electrolyte, where during and/or immediately after immersing the substrate, either: (i) a current applied to the substrate is controlled, or (ii) a voltage applied between the substrate and a reference is controlled; (c) measuring either a voltage response or a current response during and/or immediately after immersion, where: (i) the voltage response is measured if the current applied to the substrate is controlled in (b)(i), or (ii) the current response is measured if the voltage applied to the substrate is controlled in (b)(ii); (d) comparing the voltage response or current response measured in (c) to a threshold voltage, a threshold current, or a threshold time, where the threshold voltage, threshold current, or threshold time is selected to distinguish between (1) cases where the substrate includes the unacceptably high amount of oxide present on the surface of the substrate and (2) cases where the substrate includes an acceptably low amount of oxide present on the surface or no oxide present on the surface of the substrate; and (e) determining, based on the comparison in (d), whether the substrate includes the unacceptably high amount of oxide on the surface of the substrate.

These and other features will be described below with reference to the associated drawings.

DETAILED DESCRIPTION

Figure 1:
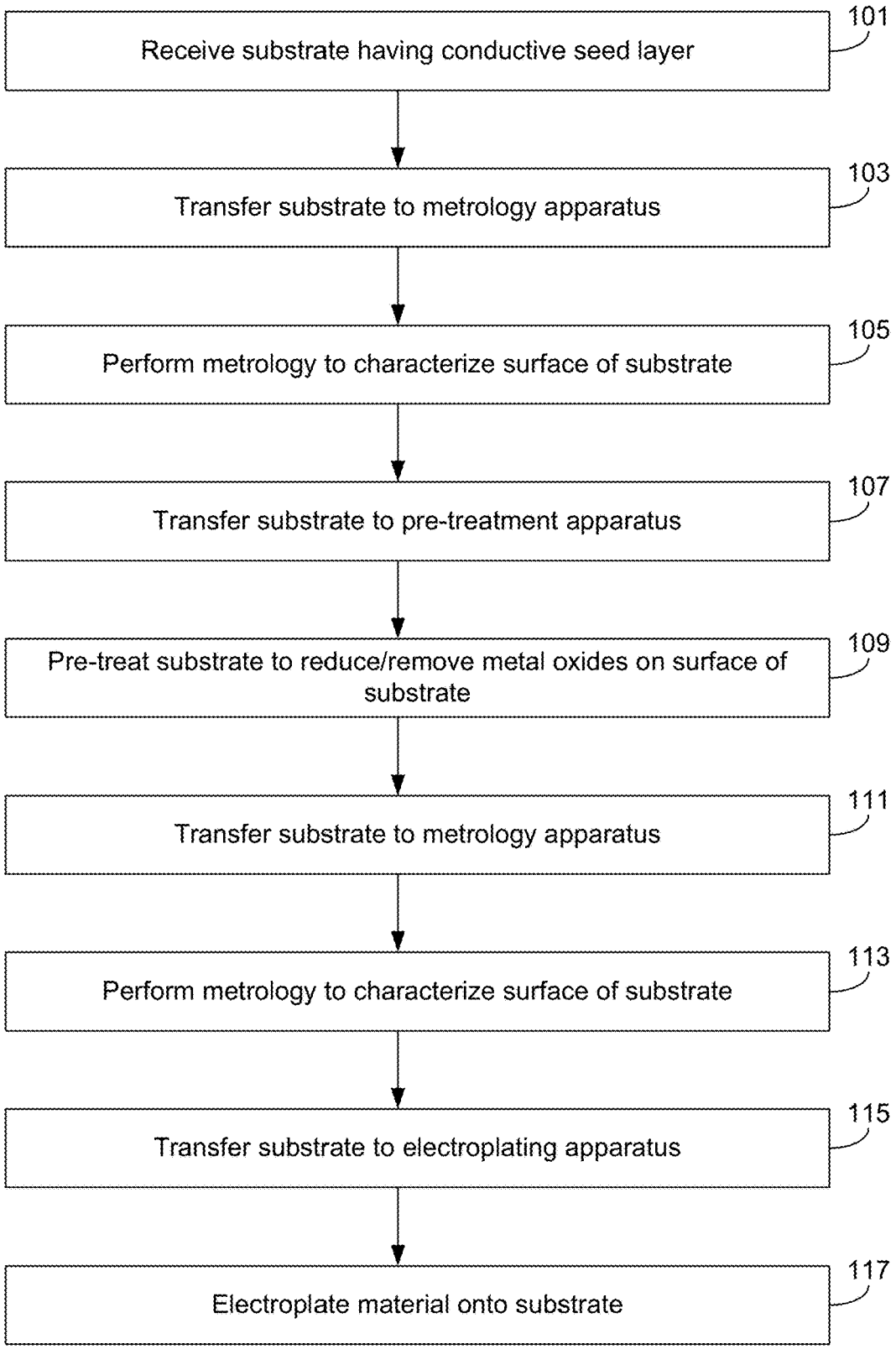
FIG. 1 is a flowchart describing a method of pre-treating and electroplating a substrate, where a separate tool is used to perform metrology on the substrate.

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. A wafer or substrate used in the semiconductor device industry typically has a diameter of 200 mm, or 300 mm, or 450 mm. Further, the terms "electrolyte," "plating bath," "bath," and "plating solution" are used interchangeably. The following detailed description assumes the embodiments are implemented on a wafer. However, the embodiments are not so limited. The work piece may be of various shapes, sizes, and materials. In addition to semiconductor wafers, other work pieces that may take advantage of the disclosed embodiments include various articles such as printed circuit boards, magnetic recording media, magnetic recording sensors, mirrors, optical elements, micro-mechanical devices and the like.

In the following description, numerous specific details are set forth in order to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

One issue that can be problematic during electroplating is the presence of oxide (e.g., metal oxide) on the surface of the substrate. Often, a substrate that is to be electroplated is provided with a conductive seed layer thereon. This seed layer, which is typically metal, can quickly become oxidized when exposed to an oxygen-containing atmosphere. The oxide can interfere with the electroplating process, and can be especially problematic when electroplating metal into recessed features, e.g., using a bottom-up fill mechanism. In many cases, oxide present on the seed layer will lead to formation of unwanted voids as the features are filled.

The substrate may be subjected to a pre-treatment process before electroplating takes place in order to remove any oxide present on the surface of the substrate. Various pre-treatment processes may be used, for example as described in any of the following U.S. Patents and Patent Applications, each of which is herein incorporated by reference in its entirety: application Ser. No. 13/546,146, filed Jul. 11, 2012, and titled "DEPOSIT MORPHOLOGY OF ELECTROPLATED COPPER AFTER SELECTIVE REMOVAL OF COPPER OXIDES DURING PRETREATMENT"; application Ser. No. 13/741,151, filed Jan. 14, 2013, and titled "METHODS FOR REDUCING METAL OXIDE SURFACES TO MODIFIED METAL SURFACES"; U.S. Pat. No. 9,070,750, titled "METHODS FOR REDUCING METAL OXIDE SURFACES TO MODIFIED METAL SURFACES USING A GASEOUS REDUCING ENVIRONMENT"; U.S. Pat. No. 9,469,912, titled "PRETREATMENT METHOD FOR PHOTORESIST WAFER PROCESSING"; and U.S. Pat. No. 9,472,377, titled "METHOD AND APPARATUS FOR CHARACTERIZING METAL OXIDE REDUCTION."

The pre-treatment process often involves exposing the substrate to reducing conditions such that the metal oxide present on the surface of the substrate is reduced to metal. The reducing conditions may be established by exposing the substrate to liquid, gas, and/or plasma that includes reducing chemistry. One method commonly used to pre-treat substrates prior to electroplating involves exposing the substrate to hydrogen-containing plasma. The hydrogen in the plasma reacts with and reduces the metal oxide on the surface of the substrate. The pre-treatment process often takes place in an apparatus that is separate from the electroplating apparatus (although in some cases, a pre-treatment module may be included in an electroplating apparatus, where the pre-treatment module is used to reduce metal oxides on the substrate prior to electroplating).

In certain cases, one or more metrology methods may be used after a substrate is pre-treated and before the substrate is electroplated. The metrology methods may be used to evaluate/characterize the surface of the substrate, for example to determine whether and to what extent metal oxide is present on the substrate surface. In some cases, the metrology methods involve measuring a sheet resistance of a metal seed layer. In a typical example, the sheet resistance may be measured by placing four micron-scale probes in contact with the substrate. The probes often result in deformation of the substrate surface, which may make this metrology method unsuitable for substrates having features patterned therein (e.g., because the features become deformed). Other metrology methods may involve optical techniques that measure an optical property (e.g., reflectivity or other optical property) of the substrate surface. Any features patterned into the substrate surface can reflect/refract the light from the metrology tool, making it difficult (and in some cases effectively impossible) to correctly interpret the metrology results. Moreover, the optical signal generated from surface oxides is typically very small, meaning that it is relatively difficult to detect surface oxides using optical metrology methods.

The metrology tools are typically standalone tools. It is difficult to incorporate the metrology tools into an electroplating apparatus for various reasons including, but not limited to, the large footprint/form factors of the apparatuses involved and the cost of integrating the components into a single apparatus.

While conventional metrology methods provide insight regarding the surface of the substrate and the effectiveness of the pre-treatment process, such methods also present additional difficulties. For example, for the reasons described above, conventional metrology methods may be of limited value in cases where the substrate is patterned. Moreover, due to queue times involved with processing, the metrology methods may not accurately reflect the surface of the substrate immediately following a pre-treatment process or immediately prior to electrodeposition, which mitigates the relevancy of the metrology results.

FIG. 1 provides a flowchart describing a method of electroplating a substrate. The method begins at operation 101, where a substrate having a conductive seed layer is received. Often, the seed layer is a metal seed layer. The substrate may include a number of features, for example in a patterned photoresist layer. Next, at operation 103 the substrate is transferred to a metrology apparatus. At operation 105, the surface of the substrate is characterized in the metrology apparatus. This metrology operation 105 may involve measuring a sheet resistance or an optical property of the seed layer to determine whether (and to what degree) metal oxide is present on the surface of the substrate. In certain embodiments, operations 103 and 105 may be omitted. At operation 107, the substrate is transferred to a pre-treatment apparatus. At operation 109, the substrate is pre-treated to reduce or otherwise remove metal oxide on the substrate surface. Any of various pre-treatment methods may be used, as described above. Next, at operation 111, the substrate is transferred back into the metrology apparatus. At operation 113, the surface of the substrate is characterized in the metrology apparatus. In certain cases, the metrology results from operations 105 and 113 may be compared against one another to evaluate the effectiveness of the pre-treatment process in operation 109. Next, at operation 115 the substrate is transferred to an electroplating apparatus. At operation 117, the substrate is electroplated.

Due to practical limitations involved with semiconductor fabrication, each of the transfer operations (e.g., operations 103, 107, 111, and 115) often takes several hours (e.g., 1-12 hours for each transfer). For example, a substrate may spend several hours in a queue before the next apparatus is available for use. These long queue times significantly reduce the accuracy and relevance of the metrology results. For instance, if there is a long queue time in operation 111 (after pre-treating the substrate in operation 109 and before performing the metrology in operation 113), metal oxide may reform on the surface of the substrate after pre-treating and prior to metrology. As a result, the metrology results from operation 113 may not accurately reflect the surface of the substrate immediately following the pre-treatment process in operation 109. This means that the metrology results do not accurately measure how well the pre-treatment process is working. A long queue time in operation 107 may likewise affect the relevance of the metrology results from operation 105, which may make it difficult to characterize the effectiveness of the pre-treatment process in operation 109. Similarly, if there is a long queue time in operation 115, metal oxide may reform on the surface of the substrate after the metrology and prior to electroplating. The result is that the metrology results from operation 113 may not accurately reflect the surface of the substrate immediately prior to electroplating. This means that the metrology results do not accurately measure the on-substrate conditions present at the time of electroplating.

In various embodiments herein, the surface of the substrate may be characterized in an electroplating apparatus (e.g., within an electroplating chamber). The characterization may involve determining whether (and in some cases to what extent) oxide is present on the surface of the substrate. In various embodiments the characterization may involve determining whether an unacceptably high amount of oxide is present on the surface of the substrate. The amount of oxide that is "acceptable" or "unacceptable" may depend on the particular application. For example, the size and layout of the features, the composition of the electrolyte, and various other plating conditions may affect the acceptable degree of oxide. In some cases, an acceptable amount of oxide may be an amount that is negligible in practice. In some cases, an acceptable amount of oxide may be essentially no oxide (e.g., no detectable oxide). In some other cases, an acceptable amount of oxide may be higher.

The characterization may be done as part of an electroplating process. The disclosed embodiments eliminate the need for a separate metrology tool, and also eliminate the transfer/queue times associated with a separate metrology tool. In this way, the metrology results more accurately reflect the relevant conditions on the substrate surface.

Figure 2:
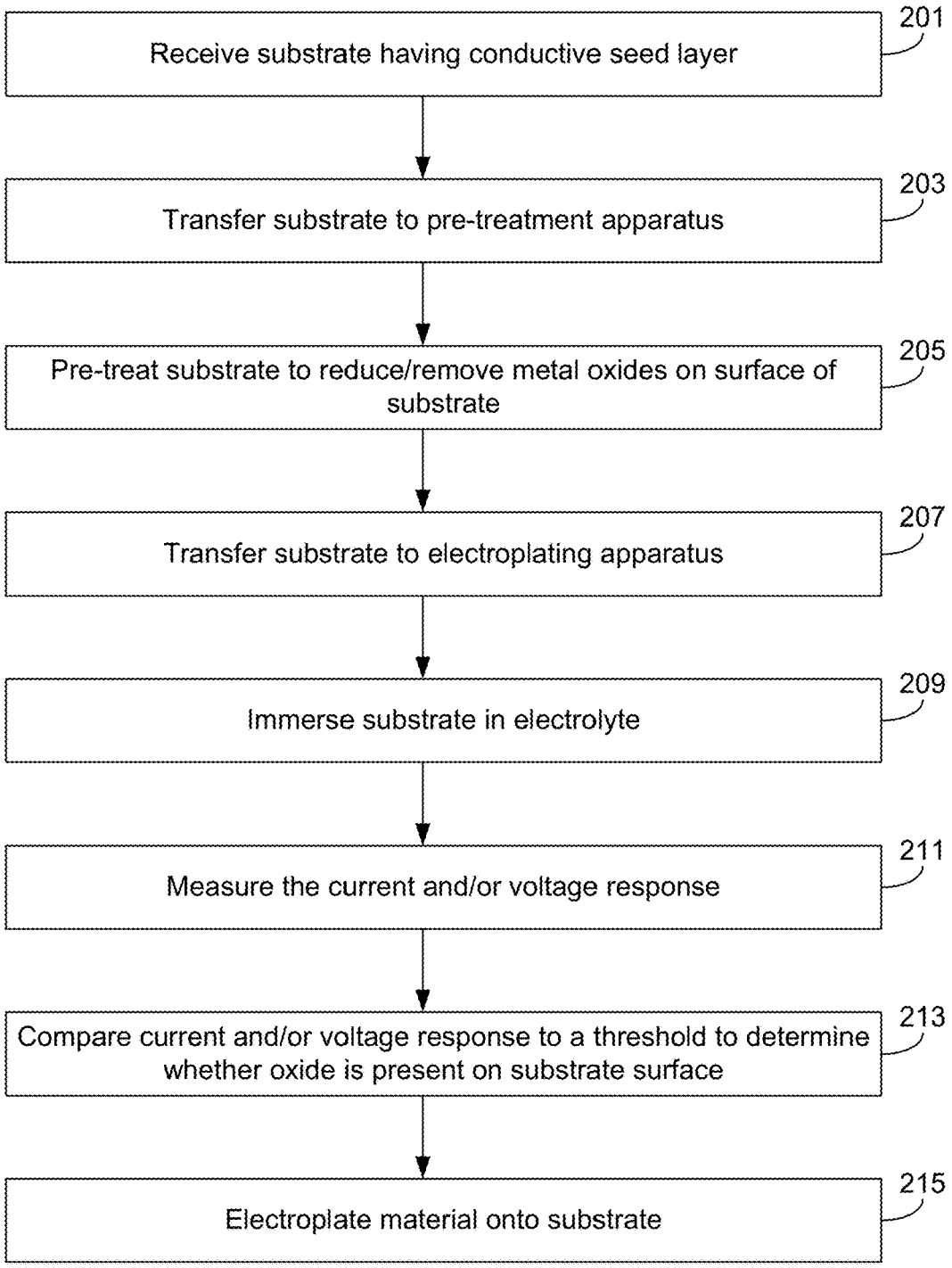
FIG. 2 is a flowchart describing a method of pre-treating and electroplating a substrate, where metrology is performed in the electroplating apparatus during an initial portion of an electroplating process.

FIG. 2 illustrates a method of electroplating a substrate according to various embodiments herein. The method begins at operation 201, where a substrate having a conductive seed layer is provided. As mentioned above, the seed layer may be a metal seed layer, and the substrate may be patterned to include a number of features. Next, at operation 203, the substrate is transferred to a pre-treatment apparatus. The pre-treatment apparatus may be a standalone tool, or it may be incorporated as a pre-treatment module in an electroplating apparatus. Next, at operation 205, the substrate is pre-treated to reduce or otherwise remove oxide present on the surface of the substrate. Any pre-treatment methods may be used, as described above.

After the substrate is pre-treated, it is transferred to the electroplating apparatus in operation 207. In cases where the pre-treatment apparatus is part of the electroplating apparatus, operation 207 may involve transferring the substrate from a pre-treatment module to an electroplating module of the electroplating apparatus. In such cases, the transfer time between the pre-treatment module and the electroplating module is very short, e.g., about 10 seconds. In some cases, the transfer time between these modules is between about 1 second and 1 minute, or between about 1-30 seconds. The transfer in operation 207 may be done in an environment that is substantially free of oxygen (e.g., containing only trace amounts of oxygen) to avoid formation of surface oxides prior to electroplating. In some cases, the transfer in operation 207 may be done via a load lock or other controlled atmosphere environment. In some other cases, the transfer in operation 207 may involve exposing the substrate to an oxygen-containing environment. The exposure to oxygen may be sufficiently short such that no oxide (or only a negligible amount of oxide) forms on the substrate surface.

Next, the substrate is immersed in electrolyte in operation 209. In various cases, the substrate may be immersed without any current or voltage applied to the substrate during immersion. In some other cases, the substrate may be immersed with an applied voltage or an applied current. As used herein, an "applied current" and a "current applied to the substrate" refer to a controlled current. In other words, when an applied current is used, the power supply actively controls the amount of current delivered to the substrate. In such a case, the voltage delivered to the substrate is not actively controlled, though it may be measured/monitored, and may be referred to as the "voltage response." Similarly, an "applied voltage" or a "voltage applied to the substrate" refer to a controlled voltage. Where an applied voltage is used, the power supply actively controls the amount of voltage delivered between the substrate and a reference (e.g., the anode or reference electrode). In this case, the current delivered to the substrate is not actively controlled, though it may be measured/monitored, and may be referred to as the "current response."

At operation 211, the current and/or voltage response is measured and recorded. The current response may be the current provided to the substrate, and the voltage response may be the potential between the substrate and a given reference (e.g., the anode or a reference electrode). The current and/or voltage responses may be measured at a particular time or over a period of time to create a current trace and/or voltage trace. In many cases, the current response and/or voltage response are measured and recorded during immersion and/or shortly after immersion. In most cases, the current response and/or voltage response provide relevant information about the presence or absence of oxide on the surface of the substrate within the first 10 seconds after initial or full immersion. In many cases, the current response and/or voltage response provide this information in a much shorter time period, for example within 5 seconds after initial or full immersion, or within 1 second after initial or full immersion, or within 0.5 seconds after initial or full immersion, or within about 0.25 seconds after initial or full immersion. In various embodiments, the current response and/or voltage response may be measured at a time (or times) within these ranges.

In one example, operation 209 involves immersing the substrate with zero applied current (often referred to as a cold entry), and operation 211 involves measuring the open circuit potential between the substrate and a reference (e.g., the anode or reference electrode). In another example, operation 209 involves immersing the substrate while applying/controlling a current to the substrate, and operation 211 involves measuring the potential between the substrate and a reference. In another example, operation 209 involves immersing the substrate while applying/controlling a potential between the substrate and a reference, and operation 211 involves measuring the current provided to the substrate.

Next, at operation 213 the current and/or voltage response measured in operation 211 is compared to a threshold response. In one example, time-based monitoring is used, where the current and/or voltage are measured at a particular time after immersion (e.g., at a target time), then compared to a threshold current and/or threshold voltage. The threshold current and/or threshold voltage (as well as the target time when the current/voltage are measured) may be selected based on a calibration procedure designed to distinguish between desirable substrate surface conditions (e.g., where the substrate surface is free of oxide, or only has a negligible amount of oxide present) and undesirable substrate surface conditions (e.g., where the substrate surface has more than a negligible amount of oxide present). Such calibration techniques are further discussed below. In certain examples, the target time may be between about 10 ms and 10 s. The target time depends on the time it takes for any oxide present on the substrate surface to dissolve in the electrolyte. This time may be affected by various factors including, but not limited to, the type of metal on the substrate, the pH of the electrolyte (lower pH leads to faster dissolution of oxide), and the amount of oxide on the surface. For some electrolyte/metal combinations, the target timeframe may fall outside the 10 ms to 10 s range.

In another example, current- and/or voltage-based monitoring may be used. In such cases, operation 211 may involve monitoring how long it takes for the current response and/or voltage response to reach a particular target current or target voltage. This time can then be compared in operation 213 against a threshold time for reaching the particular target current/target voltage. The threshold time and target current/voltage may be selected based on the calibration techniques described below. In a further example, maximum current- and/or maximum voltage-based monitoring may be used. In these cases, operation 213 may involve comparing the maximum current and/or maximum voltage measured in operation 211 against a threshold maximum current or a threshold maximum voltage. The threshold maximum current and threshold maximum voltage may be determined based on the calibration techniques described below. In another example, a more complicated monitoring method may be used. For instance, operation 213 may involve integrating the current and/or voltage response over time, and comparing the integrated current response and/or integrated voltage response to a threshold integrated current and/or a threshold integrated voltage. As used herein, the term "threshold current" may refer to a threshold current at a target time, or a threshold maximum current, or a threshold integrated current, unless stated otherwise. Similarly, the term "threshold voltage" may refer to a threshold voltage at a target time, or a threshold maximum voltage, or a threshold integrated voltage, unless stated otherwise. The various options for comparison in operation 213 can be better understood in the context of FIGS. 3A and 3B, described further below.

The comparison in operation 213 can be used to determine whether oxide is present on the surface of the substrate. Experimental results, discussed further below, indicate that the current/voltage traces are sensitive to the presence of oxide on the substrate surface. As such, these values can be used to evaluate/monitor surface oxides without the need to use a separate metrology tool. Advantageously, these methods can be used on patterned substrates with a high degree of accuracy, without deforming the features and without any need to deconvolute/decode complicated optical signals.

At operation 215, the substrate is electroplated. In some cases, the material may begin to be deposited at an earlier stage, for example at operation 209 when the substrate is immersed in electrolyte. Notably, the method described in FIG. 2 does not involve transferring the substrate to or from a separate metrology tool. As such, the queue times associated with such a transfer are eliminated. Elimination of this queue time reduces the risk that oxide will form on the substrate surface after pre-treatment and before electroplating (e.g., because several hours of queue time waiting for the metrology tool to become available can be eliminated). Moreover, because the metrology to characterize the substrate surface is performed during electroplating (e.g., during and/or immediately following immersion in many cases), the metrology results are more likely to accurately reflect the on-surface conditions when the substrate is electroplated.

In order to analyze the current and/or voltage data generated in operation 211, a calibration procedure may be used to identify a range of appropriate current and/or voltage responses. Such responses may indicate that the surface of the substrate is adequately free of oxide, and are distinguished from responses that indicate that the surface of the substrate includes a more-than-negligible amount of oxide. The calibration procedure may involve electroplating a series of calibration substrates having differing amounts of oxide present on the substrate surface and recording the current and/or voltage during and/or immediately following immersion. Some of the calibration substrates may have no oxide on the surface, some may have negligible/acceptable amounts of oxide on the surface, and some of the calibration substrates may have an unacceptable amount of oxide on the surface. By including a range of surface oxide conditions among the different calibration substrates, it is possible to identify current and/or voltage responses that indicate that the substrate surface is adequately oxide-free, and to distinguish these from responses that indicate that the substrate surface includes too much oxide.

Various factors should be controlled while electroplating the calibration substrates. These factors should generally reflect the conditions that will be used when electroplating substrates used for fabrication (e.g., substrates other than calibration substrates). Factors that should be controlled and kept uniform between plating on the calibration substrates and later processed substrates include, but are not limited to: (1) the size (e.g., diameter) of the substrate; (2) the material of the substrate, including the material of the seed layer; (3) the structure of the substrate, including the thickness of the seed layer, the presence of underlying structures, and the layout of features; (4) the applied current and/or applied voltage, if any, applied during and/or immediately after immersion; (5) the time at which (or over which) the current and/or voltage are measured; (6) the composition of the electrolyte (including, e.g., pH, concentration of accelerator, concentration of suppressor, concentration of leveler, concentration of other additives, concentration of halides, concentration of metal ions, etc.); (7) the entry conditions (e.g., vertical speed of immersion, tilt angle and speed during immersion, rate of rotation of substrate during immersion, etc.); and (8) any related processing conditions such as temperature of electrolyte, temperature of substrate, pressure, etc.

In various embodiments, one or more (in some cases all) of the listed factors do not vary substantially between those used to process the calibration substrates and those used to process production substrates. As used herein, this means that the listed factors may vary by no more than about 5%, as compared to what is used for the production substrate. In one example, a production substrate is immersed at a vertical speed of 10 cm/s, and the calibration substrates may be immersed at a vertical speed between 9.5-10.5 cm/s (10 cm/s*0.05=0.5, so that the range of acceptable vertical immersion speeds is 10 cm/s±0.5 cm/s). In some examples, one or more (in some cases all) of the listed factors do not vary more than about 2%, as compared to what is used for the production substrate.

Figure 3A:
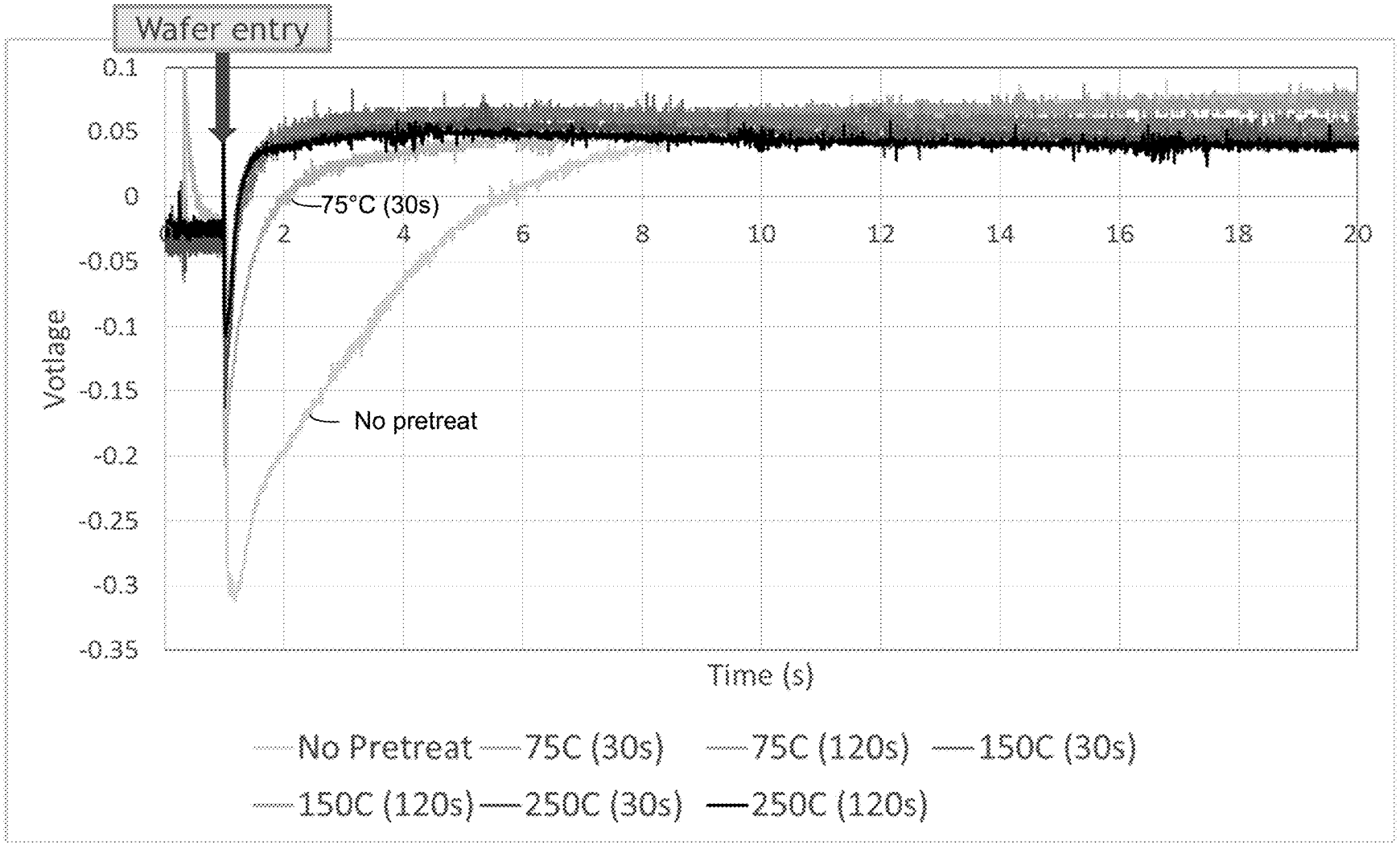
FIGS. 3A and 3B depict voltage traces for various substrates having either a cobalt seed layer (FIG. 3A) or a copper seed layer (FIG. 3B) having differing amounts of oxide on the surface as a result of different pre-treatment operations.

FIG. 3A illustrates voltage traces for a series of calibration substrates having different surface conditions prior to electroplating. These voltage traces were obtained by applying open circuit conditions (zero applied current) during immersion to each calibration substrate, and measuring the open circuit voltage for each calibration substrate over time. In the case of FIG. 3A, the seed layer was a cobalt seed layer. One calibration substrate was not exposed to any pre-treatment procedure, and therefore had an unacceptably high amount of native surface oxide present on the substrate surface. The remaining calibration substrates were subjected to various pre-treatment processes that involved exposing the substrates to a hydrogen-containing plasma to reduce the cobalt oxide to cobalt metal. The pre-treatment processes were performed at a variety of temperatures (75° C., 150° C., and 250° C.), for a duration of either 30 or 120 seconds. Generally, it is expected that pre-treatments performed at higher temperatures and/or for longer time periods result in greater reduction of surface oxides (up to a point at which the oxide is substantially removed). The pre-treatment process performed at the lowest temperature (75° C.) for the shortest time (30 seconds) did not result in removal of all the surface oxide, as indicated by the fact that the magnitude of the open circuit potential is substantially greater compared to the remaining substrates that experienced higher temperature and/or longer pretreatment processes.

As described in relation to operations 211 and 213 of FIG. 2, the current response and/or voltage response may be analyzed in various ways. In one example, the magnitudes of the open circuit potential may be evaluated at a particular target time (or at several target times), where the target time is selected to distinguish between (1) cases in which the oxide is absent or present at only negligible amounts, and (2) cases in which the oxide is present at a greater-than-negligible amount. In the context of FIG. 3A, this target time may be selected to be about 0.5 seconds after immersion, for example. At the target time, a threshold voltage can be selected, where voltage responses having a magnitude less than the threshold voltage correspond to cases where the oxide was absent or present at acceptably low levels, and voltage responses having a magnitude greater than the threshold voltage correspond to cases where the oxide was present at an unacceptably high level. A similar method may be used for comparing a current response to a threshold current at a target time.

In another example, the data may be used to determine a time at which the voltage response and/or current response reach a particular target voltage or target current. The target voltage or target current can be selected to distinguish between cases (1) and (2) as stated above. At the target voltage or target current, a threshold time can be selected, where substrates that reach the target voltage or target current earlier than the threshold time correspond to cases where the oxide was absent or present at acceptably low levels, and substrates that reach the target voltage or target current after the threshold time correspond to cases where oxide was present at an unacceptably high level.

In another example, the data may be used to determine the maximum voltage response or maximum current response. While it is difficult to see at the timescale shown in FIG. 3A, substrates having different surface oxide conditions exhibited different maximum/peak voltage responses. Based on these responses, a threshold maximum voltage can be selected to distinguish between cases (1) and (2) as stated above. Similarly, in cases where the current response is monitored, a threshold maximum current can be selected to distinguish between cases (1) and (2). Substrates exhibiting maximum voltage responses or maximum current responses having magnitudes less than the threshold maximum voltage or threshold maximum current, respectively, correspond to cases where the oxide was absent or present at acceptably low levels. Conversely, substrates that exhibit maximum voltage responses or maximum current responses having magnitudes greater than the threshold maximum voltage or threshold maximum current correspond to cases where the oxide was present at an unacceptably high level.

In a further example, the data may be integrated over a target timeframe. For instance, the voltage response may be integrated over the target timeframe to determine an integrated voltage response. Likewise, the current response may be integrated over the target timeframe to determine an integrated current response. In various embodiments, the absolute value of the voltage response and/or current response is used, and the integration is performed based solely on the magnitude (and not the sign) of the voltage response and/or current response over time. By considering only the magnitude/absolute value of the voltage/current response, certain definitional differences (e.g., the polarity of voltage) can be ignored. A threshold integrated voltage response or a threshold integrated current response can be selected to distinguish between cases (1) and (2) as mentioned above. Substrates that exhibit an integrated voltage response or integrated current response that is less than the threshold integrated voltage or the threshold integrated current, respectively, corresponds to cases where the oxide was absent or present at acceptably low levels. Conversely, substrates that exhibit integrated voltage responses or integrated current responses greater than the threshold integrated voltage or threshold integrated current correspond to cases where the oxide was present at an unacceptably high level.

The results in FIG. 3A indicate that the oxide was fully removed from an untreated film after about 9-10 seconds. Further, there is a subtle difference in steady state open circuit potential for calibration substrates exposed to different pre-treatments, with more aggressive pre-treatments generally resulting in slightly lower magnitudes for the steady state open circuit potential. These differences may be a result of structural changes in the seed layer that occur during pre-treatment.

Figure 3B:
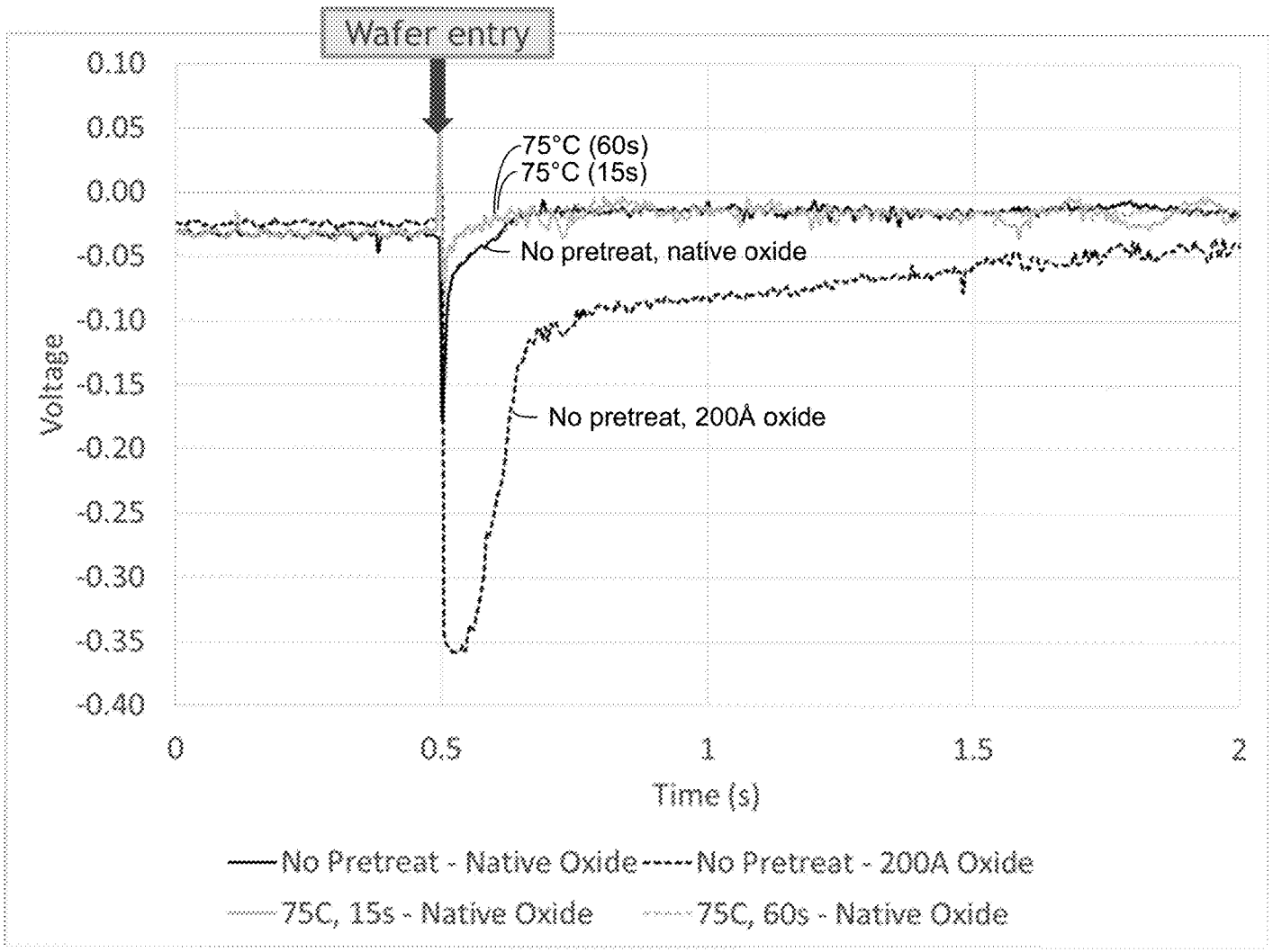

FIG. 3B illustrates voltage traces for a series of calibration substrates having different surface conditions prior to electroplating. Like the results in FIG. 3A, the results in FIG. 3B were obtained by applying open circuit conditions during immersion to each calibration substrate, and measuring the open circuit voltage for each calibration substrate over time. In the case of FIG. 3B, the seed layer was copper (as opposed to the cobalt seed layer used in connection with FIG. 3A). One calibration substrate was not exposed to any pre-treatment process, and therefore had an unacceptably high degree of native oxide present on the surface. Another calibration substrate was not exposed to any pre-treatment process, and also had a 200 Å thick oxide layer deposited thereon. The 200 Å thick oxide layer is understood to be an unacceptably high amount of oxide. The remaining calibration substrates were each exposed to a pre-treatment process that involved exposing the substrate to hydrogen-containing plasma to reduce copper oxide on the surface to copper metal. The pre-treatment processes were performed at 75° C., for a duration of either 15 or 60 seconds. Here, the calibration substrate having a 200 Å thick oxide layer showed the highest magnitude for open circuit potential. The calibration substrate that was not exposed to any pre-treatment and had native oxide on the surface showed a reduced magnitude open circuit potential. The magnitude of the open circuit potential was lower still for the calibration substrates exposed to pre-treatment processes.

These results can be used to identify a range of acceptable open circuit potentials for a given target time (or times) during and/or after immersion. For instance, the acceptable range may be set to include the open circuit potentials experienced by the substrates that were pre-treated, and to exclude the open circuit potentials experienced by the substrates that were not pre-treated. As described in relation to FIG. 3A, the target time at which the open circuit potential (or other electrical response) is measured is selected to distinguish between cases where the amount of oxide is acceptable (e.g., none or negligible) vs. cases where the amount of oxide is unacceptable (e.g., greater than negligible). Similarly, the data can be used to select one or more target time or timeframe, a target voltage, a target current, a threshold time, a threshold voltage, a threshold current, a threshold maximum voltage, a threshold maximum current, a threshold integrated voltage, a threshold integrated current, etc. These targets and thresholds can be selected to distinguish between different surface oxide conditions, as described herein. The results in FIG. 3B suggest that both of the pre-treatment processes resulted in fully reducing the native oxide.

While FIGS. 3A and 3B are presented in the context of applying open circuit conditions and measuring an open circuit voltage, the methods are not so limited. As mentioned above, the method may also involve applying particular current conditions and measuring a voltage response, or applying particular voltage conditions and measuring a current response.

In certain implementations, the current and/or voltage trace may be used to provide feedback that directly affects how the electroplating process is controlled. For example, the current and/or voltage trace may be used to determine the point in time at which the native oxide is fully (or sufficiently) removed from the surface of the substrate. In one example, an applied current or an applied voltage used to electroplate material onto the substrate may be applied to the substrate after the current response or voltage response indicates that any oxide present on the surface of the substrate has dissolved. This may be indicated by the current trace or voltage trace reaching a particular value (which may be determined based on the calibration procedure described above), or reaching a steady state. By waiting for the current and/or voltage response to reach a particular value or steady state, it ensures that the electroplating process does not begin (or does not substantially begin) until any oxide present on the surface is removed. This reduces the risk that voids will form during the plating process, and results in formation of high quality films that are uniform between different substrates.

In some embodiments, a particular action or actions may be taken in response to an indication that a substrate includes a more-than-negligible amount of oxide on its surface (e.g., when the magnitude of the electrical response is not within the desired/threshold range). In one example, the electroplating apparatus may be stopped and/or a warning may be given. In these or other examples, the pre-treatment apparatus may be stopped. In these or other examples, troubleshooting may occur to determine why the incoming substrates are showing greater than expected amounts of oxide. In some cases, the substrates may set off an alarm indicating a substantial amount of oxide on the surface, but the alarm may be the result of changes in the incoming substrate (e.g., composition or thickness of seed layer, etc.) that have not been accounted for, rather than a result of surface oxide. Even in such cases, the alarm is useful because it can flag changes in the incoming substrates that should be taken into account. In some cases, one or more substrates may be thrown away in response to an indication that there is too much oxide present on the surface. In some cases, the pre-treatment process may be adjusted (e.g., to use higher temperatures and/or longer exposure times) in response to an indication that substrates are being received with too much oxide on the surface. In some cases, various substrates may be pre-treated an additional time in response to an indication that one or more substrates are being received with too much oxide on the surface. This may be useful when the queue time between the pre-treatment apparatus and the electroplating module is significant.

The metrology methods described herein may also be used to select appropriate conditions for the pre-treatment process, or similarly, to evaluate whether a pre-treatment process has been successful. For example, a variety of test substrates that have been exposed to differing pre-treatment conditions can be electroplated as described in relation to FIGS. 3A and 3B. The metrology performed during and/or soon after immersion can be used to evaluate whether the pre-treatment conditions used to pre-treat each substrate were successful in adequately removing the surface oxides. For example, among the pre-treatment conditions tested in relation to FIG. 3A, the results suggest that the pre-treatment that occurred at 75° C. for 30 seconds did not adequately remove the surface oxide, as indicated by the large magnitude of the voltage trace at the relevant time (compared to the other substrates that were exposed to more aggressive pre-treatment conditions). Likewise, the results suggest that the pre-treatments that occurred at 150° C., 250° C., and/or for a duration of 120 seconds were all successful in adequately removing the surface oxides, as indicated by the reduced and substantially uniform magnitude of the voltage trace at the relevant time (compared to the other substrates that were exposed to the least aggressive pre-treatment or no pre-treatment).

Figure 4:
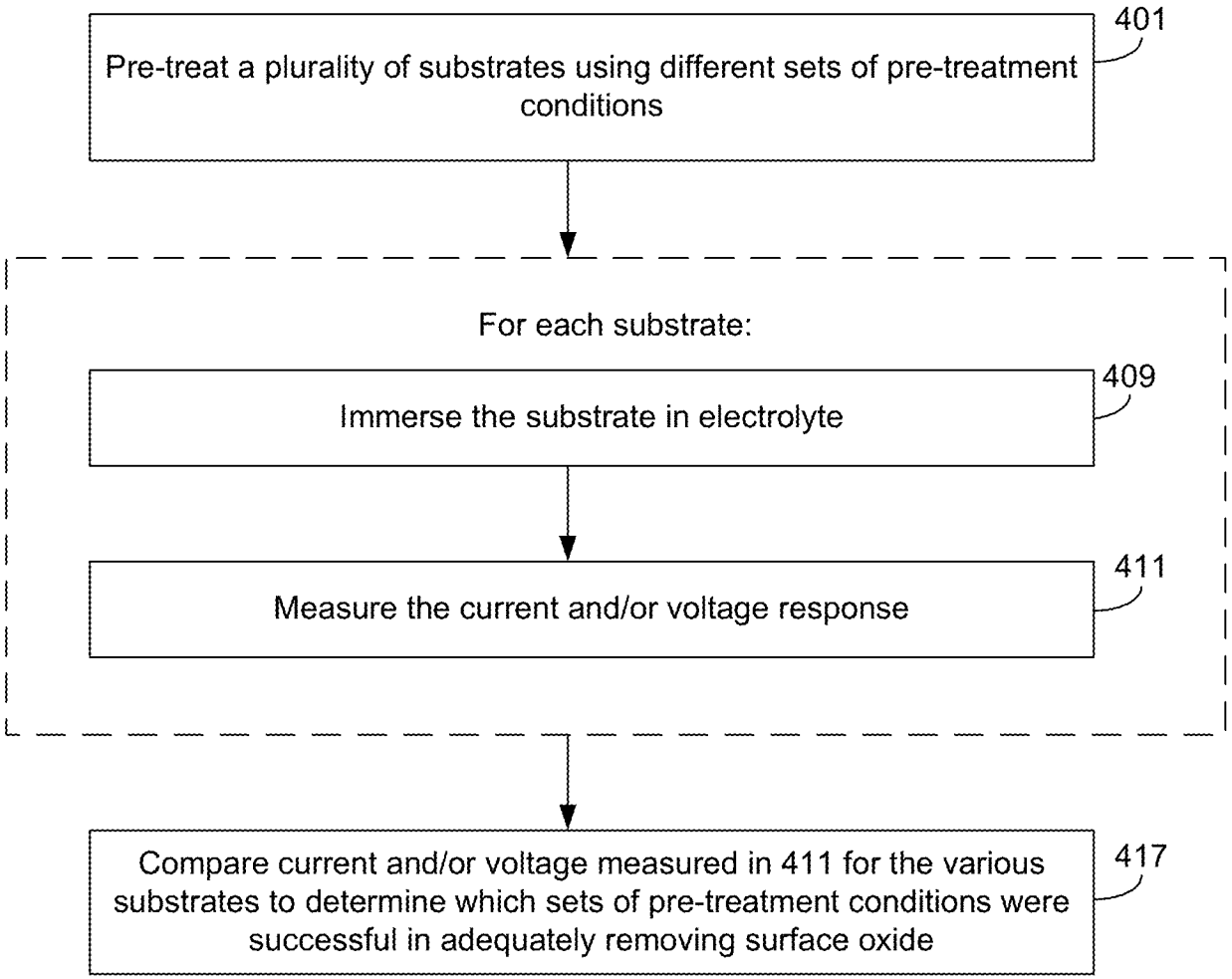
FIG. 4 is a flowchart describing a method of selecting pre-treatment conditions for pre-treating a substrate to remove surface oxides.

FIG. 4 is a flowchart describing a method of selecting conditions for a pre-treatment process designed to reduce or otherwise remove oxide from the surface of a substrate that is to be electroplated. The method begins at operation 401, where a plurality of substrates (sometimes referred to as calibration substrates) are pre-treated using different sets of pre-treatment conditions. Each substrate is pre-treated according to one set of pre-treatment conditions. However, it is understood that some substrates may not be pre-treated at all (in which case the pre-treatment conditions may specify that no pre-treatment occurs) and/or substrates that have an oxide layer purposely deposited thereon. Substrates that are known to include oxide on the surface at unacceptable amounts can provide a baseline against which comparisons can be made, for example as described in relation to FIGS. 3A and 3B, which each included at least one substrate that was not pre-treated. The pre-treatment conditions may include a variety of processing variables including, but not limited to, the composition and flow rate of gas/plasma/liquid to which the substrate is exposed, the duration of such exposure, the temperature at which the substrate is maintained, the power level used to generate plasma (if any), the duty cycle used to generate plasma (if any), the frequency used to generate plasma (if any), pressure, etc. The different sets of pre-treatment conditions vary from one another with respect to at least one processing variable. The different sets of pre-treatment conditions may cover a range of available processing conditions, including various temperatures, exposure durations, pressures, etc. For instance, with reference to FIG. 3A, seven different sets of processing conditions were tested (including one set in which no pre-treatment occurred), covering three different temperatures and two different plasma exposure durations.

Operations 409 and 411 occur for each substrate. In operation 409, the substrate is immersed in electrolyte. Operation 409 is analogous to operation 209 of FIG. 2. Next, at operation 411, the current and/or voltage response is measured during immersion and/or shortly after immersion. Operation 411 is analogous to operation 211 of FIG. 2. In one example, operation 409 involves immersing the substrate at open circuit conditions (e.g., zero current applied), and operation 411 involves measuring an open circuit voltage response. In another example, operation 409 involves immersing the substrate at a fixed non-zero current, and operation 411 involves measuring the voltage response. In another example, operation 409 involves immersing the substrate at a fixed potential and operation 411 involves measuring a current response. In any case, either the voltage or the current applied to the substrate may be controlled during and/or immediately after immersion, and the response of the other variable (e.g., current or voltage) may be measured. Optionally, each substrate may be electroplated after the initial immersion and measuring in operations 409 and 411, though this is not necessary for evaluating the different sets of pre-treatment conditions.

Next, at operation 417, the current and/or voltage responses measured in operation 411 are compared for the various substrates to determine which sets of pre-treatment conditions were successful in adequately removing the surface oxide and which sets of pre-treatment conditions were not successful. The determination may be made as described in relation to FIGS. 3A and 3B, with non-successful pre-treatments resulting in electrical responses with relatively greater magnitudes, and successful pre-treatments resulting in electrical responses with relatively lower and substantially uniform magnitudes (at a relevant time after initiation of immersion).

In cases where at least one substrate known to include surface oxide is tested, the substrates exposed to pre-treatments that adequately remove the oxide will show an electrical response having a significantly smaller magnitude than the substrates known to include oxide on the surface. The substrates exposed to pre-treatments that do not adequately remove the oxide will show an electrical response having a magnitude closer to that of the substrates known to include oxide on the surface, as described in relation to FIGS. 3A and 3B.

It is understood that while various operations are described as occurring on multiple substrates, these processes may occur serially such that only a single substrate (or some sub-set of substrates) is being processed (e.g., pre-treated or electroplated) in a particular processing chamber at a given time. In some cases, a processing apparatus may be configured to process multiple substrates simultaneously.

The method described in FIG. 4 can be used to test whether a pre-treatment method is successful, and similarly, to select a set of pre-treatment conditions that adequately remove surface oxide for a particular application.

The techniques described herein provide a number of advantages over conventional processing schemes. First, the disclosed methods significantly reduce the amount of time that a particular substrate spends in queues waiting to be processed. Because the metrology happens directly in the electroplating chamber during an initial portion of an electroplating process, there is no need to transfer the substrate to or from a separate metrology tool. The substrate may be pre-treated directly in an electroplating apparatus in some cases (e.g., in a pre-treatment module, which may be a liquid processing module, a gas processing module, or a plasma processing module), and can be transferred to the electroplating chamber/module over a matter of seconds (e.g., 10 seconds). Because the queue times are minimized or eliminated, there is substantially less risk that oxide will grow on the substrate surface after pre-treatment and before electroplating. This also means that the metrology results more accurately reflect how effective the pre-treatment process is removing the oxide material, and more accurately reflect the on-substrate conditions relevant when electroplating on the substrate.

The disclosed embodiments are also advantageous because they promote productivity. For instance, surface oxide can be monitored with little to no additional time required. Alternative metrology techniques typically have turnaround times in the range of several hours, in some cases due to queue times.

Another advantage of the disclosed embodiments is that the techniques can be used on both patterned and unpatterned substrates with a high degree of accuracy. As described above, various conventional metrology techniques are difficult or impossible to apply to patterned substrates, for example because the metrology techniques deform the features formed in the pattern, or because the pattern makes it difficult to decode the resulting signals (e.g., optical signals). Relatedly, the disclosed techniques can be used on substrates that are used for production (referred to as production substrates, which may be different from calibration substrates and/or test substrates). Production substrates are fabricated into commercial products, rather than being intentionally scrapped. Certain conventional metrology techniques could only be used on "sacrificial" substrates, for example because the substrates become deformed during metrology. Such sacrificial substrates can quickly become costly, in aggregate. By contrast, using the disclosed techniques, metrology can be performed on each production substrate without the costly loss of any useful substrates.

Moreover, the disclosed methods are advantageous because the metrology methods are designed to measure the most directly relevant property (I/V behavior) regarding the impact of surface oxide on electroplating. Conventional metrology methods such as measuring sheet resistance or optical properties each measure a property that results from the presence of surface oxide. However, these measured properties are not as directly related/relevant to the electroplating process as compared to the I/V behavior.

The disclosed techniques are also beneficial because they enable on-tool monitoring. The substrates can be monitored directly in the electroplating apparatus, without any need for a separate metrology tool. This substantially reduces metrology costs.

Apparatus

Figure 5:
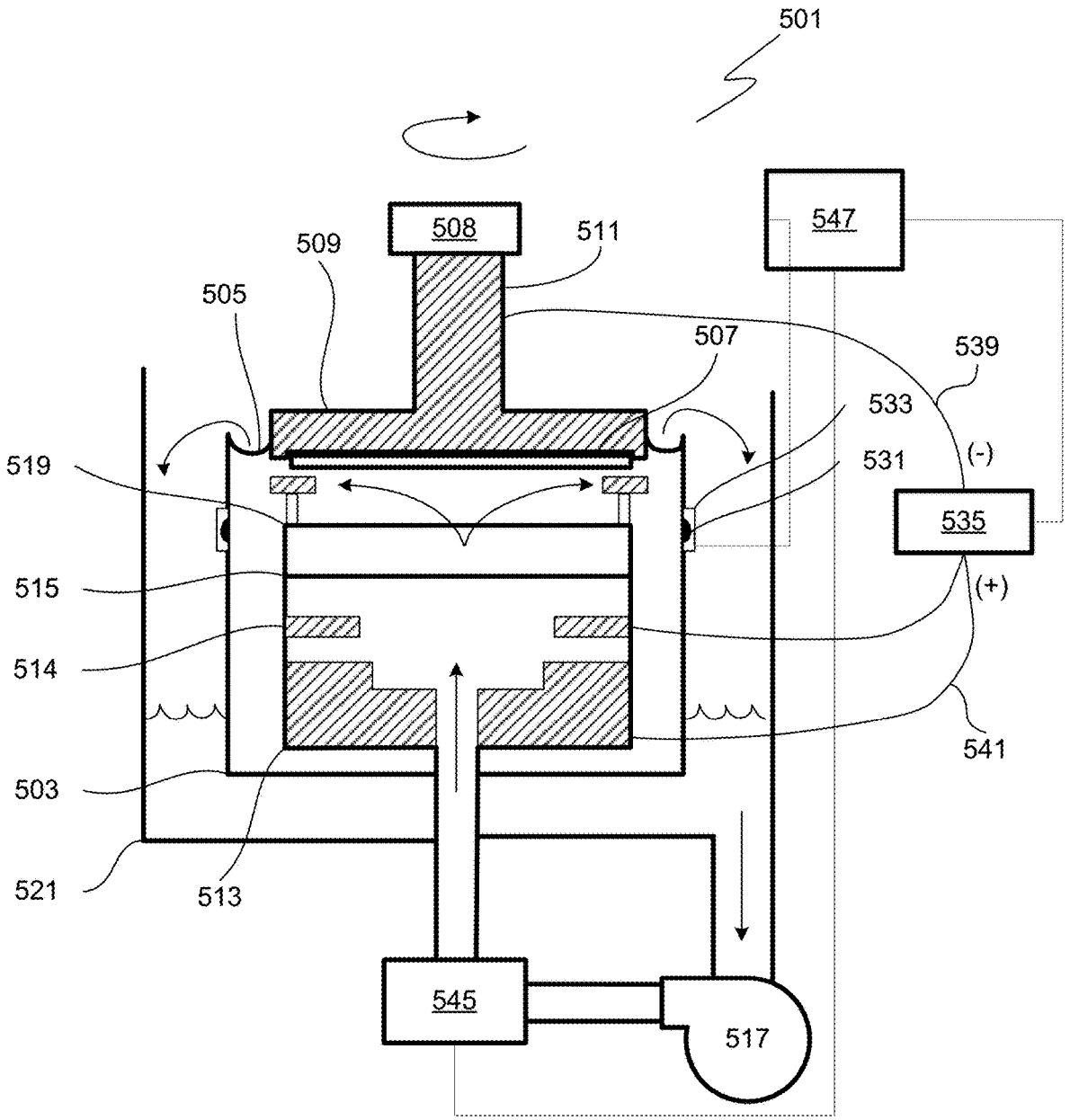
FIG. 5 illustrates an electroplating apparatus according to one embodiment.
Figure 6:
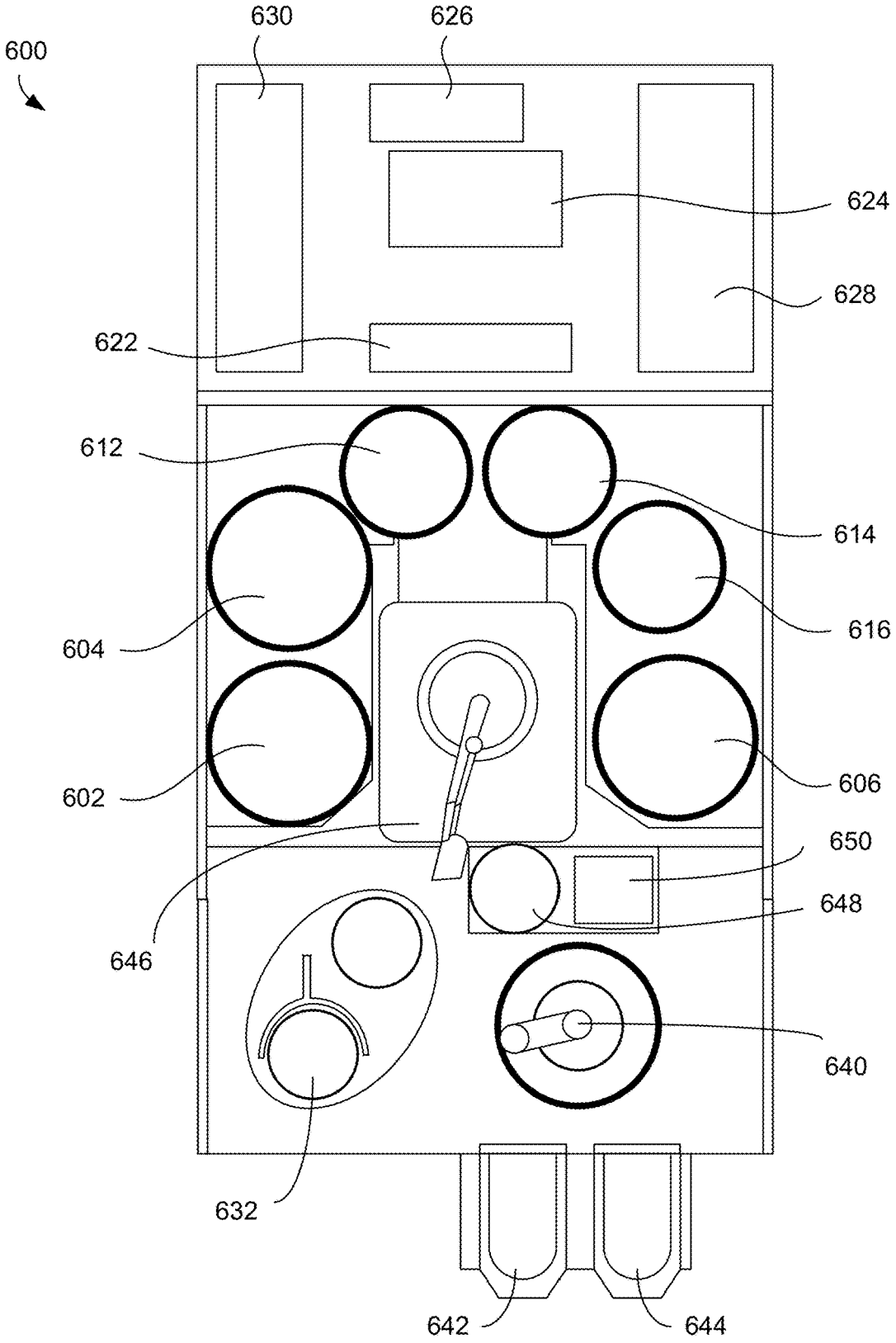
FIGS. 6 and 7 each depict a multi-tool electroplating apparatus according to certain embodiments.
Figure 7:
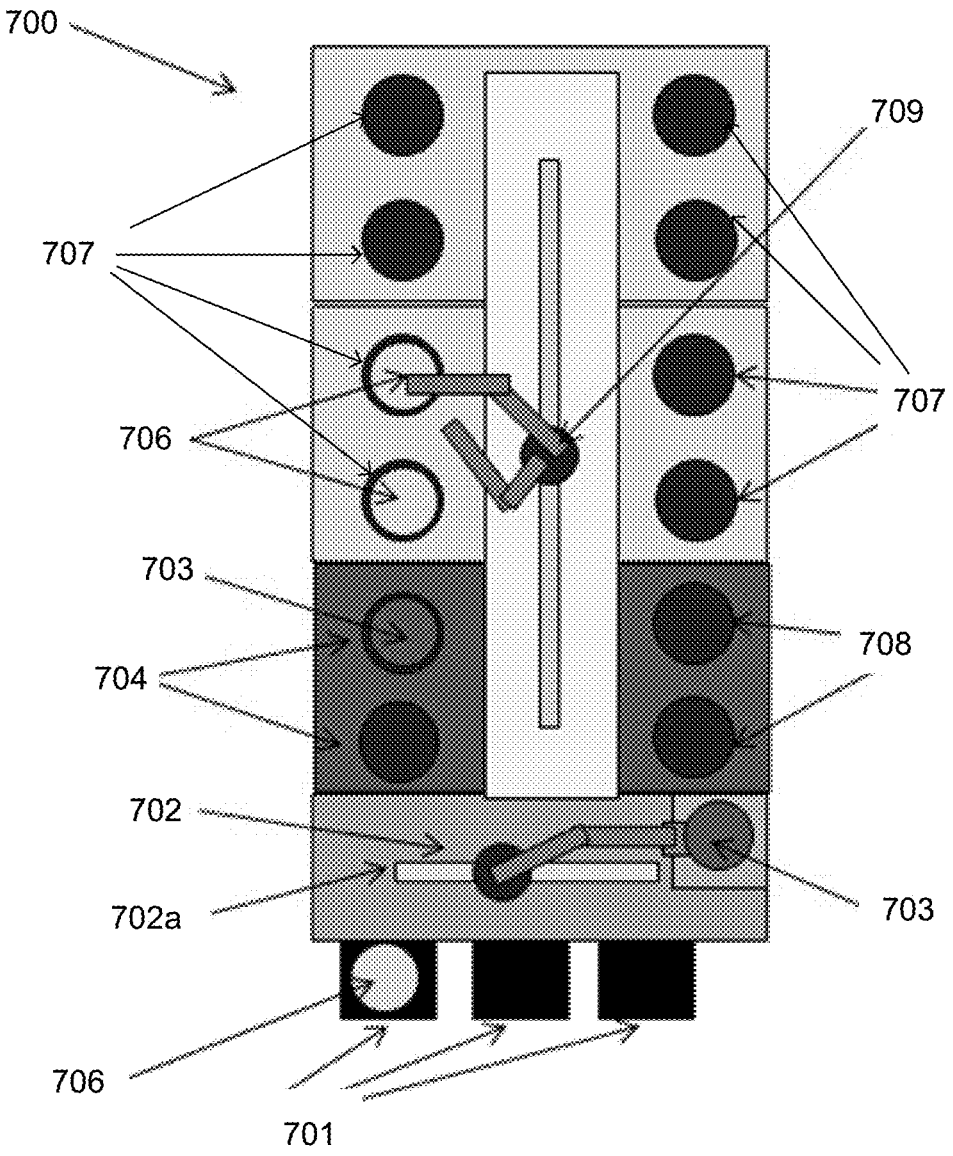

The methods described herein may be performed by any suitable apparatus. A suitable apparatus includes hardware for accomplishing the process operations and a system controller having instructions for controlling process operations in accordance with the present embodiments. For example, in some embodiments, the hardware may include one or more process stations included in a process tool. FIGS. 5-7 present examples of suitable electroplating apparatus. However, those of ordinary skill in the art understand that the disclosed techniques can be used in connection with essentially any electroplating apparatus and any pre-treatment apparatus.

FIG. 5 presents an example of an electroplating cell in which electroplating may occur. Often, an electroplating apparatus includes one or more electroplating cells in which the substrates (e.g., wafers) are processed. Only one electroplating cell is shown in FIG. 5 to preserve clarity. To optimize bottom-up electroplating, additives (e.g., accelerators, suppressors, and levelers) are added to the electrolyte; however, an electrolyte with additives may react with the anode in undesirable ways. Therefore anodic and cathodic regions of the plating cell are sometimes separated by a membrane so that plating solutions of different composition may be used in each region. Plating solution in the cathodic region is called catholyte; and in the anodic region, anolyte. A number of engineering designs can be used in order to introduce anolyte and catholyte into the plating apparatus.

Referring to FIG. 5, a diagrammatical cross-sectional view of an electroplating apparatus 501 in accordance with one embodiment is shown. The plating bath 503 contains the plating solution (having a composition as provided herein), which is shown at a level 505. The catholyte portion of this vessel is adapted for receiving substrates in a catholyte. A wafer 507 is immersed into the plating solution and is held by, e.g., a "clamshell" substrate holder 509, mounted on a rotatable spindle 511, which allows rotation of clamshell substrate holder 509 together with the wafer 507. A general description of a clamshell-type plating apparatus having aspects suitable for use with this invention is described in detail in U.S. Pat. No. 6,156,167 issued to Patton et al., and U.S. Pat. No. 6,800,187 issued to Reid et al., which are incorporated herein by reference in their entireties.

An anode 513 is disposed below the wafer within the plating bath 503 and is separated from the wafer region by a membrane 515, preferably an ion selective membrane. For example, Nafion™ cationic exchange membrane (CEM) may be used. The region below the anodic membrane is often referred to as an "anode chamber." The ion-selective anode membrane 515 allows ionic communication between the anodic and cathodic regions of the plating cell, while preventing the particles generated at the anode from entering the proximity of the wafer and contaminating it. The anode membrane is also useful in redistributing current flow during the plating process and thereby improving the plating uniformity. Detailed descriptions of suitable anodic membranes are provided in U.S. Pat. Nos. 6,126,798 and 6,569,299 issued to Reid et al., both incorporated herein by reference in their entireties. Ion exchange membranes, such as cationic exchange membranes, are especially suitable for these applications. These membranes are typically made of ionomeric materials, such as perfluorinated co-polymers containing sulfonic groups (e.g. Nafion™), sulfonated polyimides, and other materials known to those of skill in the art to be suitable for cation exchange. Selected examples of suitable Nafion™ membranes include N324 and N424 membranes available from Dupont de Nemours Co.

During plating the ions from the plating solution are deposited on the substrate. The metal ions must diffuse through the diffusion boundary layer and into the TSV hole or other feature. A typical way to assist the diffusion is through convection flow of the electroplating solution provided by the pump 517. Additionally, a vibration agitation or sonic agitation member may be used as well as wafer rotation. For example, a vibration transducer 508 may be attached to the clamshell substrate holder 509.

The plating solution is continuously provided to plating bath 503 by the pump 517. Generally, the plating solution flows upwards through an anode membrane 515 and a diffuser plate 519 to the center of wafer 507 and then radially outward and across wafer 507. The plating solution also may be provided into the anodic region of the bath from the side of the plating bath 503. The plating solution then overflows plating bath 503 to an overflow reservoir 521. The plating solution is then filtered (not shown) and returned to pump 517 completing the recirculation of the plating solution. In certain configurations of the plating cell, a distinct electrolyte is circulated through the portion of the plating cell in which the anode is contained while mixing with the main plating solution is prevented using sparingly permeable membranes or ion selective membranes.

A reference electrode 531 is located on the outside of the plating bath 503 in a separate chamber 533, which chamber is replenished by overflow from the main plating bath 503. Alternatively, in some embodiments the reference electrode is positioned as close to the substrate surface as possible, and the reference electrode chamber is connected via a capillary tube or by another method, to the side of the wafer substrate or directly under the wafer substrate. In some of the preferred embodiments, the apparatus further includes contact sense leads that connect to the wafer periphery and which are configured to sense the potential of the metal seed layer at the periphery of the wafer but do not carry any current to the wafer.

A reference electrode 531 is typically employed when electroplating at a controlled potential is desired. The reference electrode 531 may be one of a variety of commonly used types such as mercury/mercury sulfate, silver chloride, saturated calomel, or copper metal. A contact sense lead in direct contact with the wafer 507 may be used in some embodiments, in addition to the reference electrode, for more accurate potential measurement (not shown).

A DC power supply 535 can be used to control current flow to the wafer 507. The power supply 535 has a negative output lead 539 electrically connected to wafer 507 through one or more slip rings, brushes and contacts (not shown). The positive output lead 541 of power supply 535 is electrically connected to an anode 513 located in plating bath 503. The power supply 535, a reference electrode 531, and a contact sense lead (not shown) can be connected to a system controller 547, which allows, among other functions, modulation of current and potential provided to the elements of electroplating cell. For example, the controller may allow electroplating in potential-controlled and current-controlled regimes. The controller may include program instructions specifying current and voltage levels that need to be applied to various elements of the plating cell, as well as times at which these levels need to be changed. When forward current is applied, the power supply 535 biases the wafer 507 to have a negative potential relative to anode 513. This causes an electrical current to flow from anode 513 to the wafer 507, and an electrochemical reduction (e.g. $Cu^{2+}+2e^{-}=Cu^{0}$) occurs on the wafer surface (the cathode), which results in the deposition of the electrically conductive layer (e.g. copper) on the surfaces of the wafer. An inert anode 514 may be installed below the wafer 507 within the plating bath 503 and separated from the wafer region by the membrane 515.

The apparatus may also include a heater 545 for maintaining the temperature of the plating solution at a specific level. The plating solution may be used to transfer the heat to the other elements of the plating bath. For example, when a wafer 507 is loaded into the plating bath the heater 545 and the pump 517 may be turned on to circulate the plating solution through the electroplating apparatus 501, until the temperature throughout the apparatus becomes substantially uniform. In one embodiment the heater is connected to the system controller 547. The system controller 547 may be connected to a thermocouple to receive feedback of the plating solution temperature within the electroplating apparatus and determine the need for additional heating.

The controller will typically include one or more memory devices and one or more processors. The processor may include a CPU or computer, analog and/or digital input/output connections, stepper motor controller boards, etc. In certain embodiments, the controller controls all of the activities of the electroplating apparatus. Non-transitory machine-readable media containing instructions for controlling process operations in accordance with the present embodiments may be coupled to the system controller.

Typically there will be a user interface associated with controller 547. The user interface may include a display screen, graphical software displays of the apparatus and/or process conditions, and user input devices such as pointing devices, keyboards, touch screens, microphones, etc. The computer program code for controlling electroplating processes can be written in any conventional computer readable programming language: for example, assembly language, C, C++, Pascal, Fortran or others. Compiled object code or script is executed by the processor to perform the tasks identified in the program. One example of a plating apparatus that may be used according to the embodiments herein is the Lam Research Sabre tool. Electrodeposition can be performed in components that form a larger electrodeposition apparatus.

FIG. 6 shows a schematic of a top view of an example electrodeposition apparatus. The electrodeposition apparatus 600 can include three separate electroplating modules 602, 604, and 606. The electrodeposition apparatus 600 can also include three separate modules 612, 614, and 616 configured for various process operations. For example, in some embodiments, one or more of modules 612, 614, and 616 may be a spin rinse drying (SRD) module. In other embodiments, one or more of the modules 612, 614, and 616 may be post-electrofill modules (PEMs), each configured to perform a function, such as edge bevel removal, backside etching, and acid cleaning of substrates after they have been processed by one of the electroplating modules 602, 604, and 606.

The electrodeposition apparatus 600 includes a central electrodeposition chamber 624. The central electrodeposition chamber 624 is a chamber that holds the chemical solution used as the electroplating solution in the electroplating modules 602, 604, and 606. The electrodeposition apparatus 600 also includes a dosing system 626 that may store and deliver additives for the electroplating solution. A chemical dilution module 622 may store and mix chemicals to be used as an etchant. A filtration and pumping unit 628 may filter the electroplating solution for the central electrodeposition chamber 624 and pump it to the electroplating modules.

A system controller 630 provides electronic and interface controls required to operate the electrodeposition apparatus 600. The system controller 630 (which may include one or more physical or logical controllers) controls some or all of the properties of the electroplating apparatus 600.

Signals for monitoring the process may be provided by analog and/or digital input connections of the system controller 630 from various process tool sensors. The signals for controlling the process may be output on the analog and digital output connections of the process tool. Non-limiting examples of process tool sensors that may be monitored include mass flow controllers, pressure sensors (such as manometers), thermocouples, optical position sensors, etc. Appropriately programmed feedback and control algorithms may be used with data from these sensors to maintain process conditions.

A hand-off tool 640 may select a substrate from a substrate cassette such as the cassette 642 or the cassette 644. The cassettes 642 or 644 may be front opening unified pods (FOUPs). A FOUP is an enclosure designed to hold substrates securely and safely in a controlled environment and to allow the substrates to be removed for processing or measurement by tools equipped with appropriate load ports and robotic handling systems. The hand-off tool 640 may hold the substrate using a vacuum attachment or some other attaching mechanism.

The hand-off tool 640 may interface with a wafer handling station 632, the cassettes 642 or 644, a transfer station 650, or an aligner 648. From the transfer station 650, a hand-off tool 646 may gain access to the substrate. The transfer station 650 may be a slot or a position from and to which hand-off tools 640 and 646 may pass substrates without going through the aligner 648. In some embodiments, however, to ensure that a substrate is properly aligned on the hand-off tool 646 for precision delivery to an electroplating module, the hand-off tool 646 may align the substrate with an aligner 648. The hand-off tool 646 may also deliver a substrate to one of the electroplating modules 602, 604, or 606 or to one of the three separate modules 612, 614, and 616 configured for various process operations.

An example of a process operation according to the methods described above may proceed as follows: (1) electrodeposit copper or another material onto a substrate in the electroplating module 604; (2) rinse and dry the substrate in SRD in module 612; and, (3) perform edge bevel removal in module 614.

An apparatus configured to allow efficient cycling of substrates through sequential plating, rinsing, drying, and PEM process operations may be useful for implementations for use in a manufacturing environment. To accomplish this, the module 612 can be configured as a spin rinse dryer and an edge bevel removal chamber. With such a module 612, the substrate would only need to be transported between the electroplating module 604 and the module 612 for the copper plating and EBR operations. In some embodiments the methods described herein will be implemented in a system which comprises an electroplating apparatus and a stepper.

An alternative embodiment of an electrodeposition apparatus 700 is schematically illustrated in FIG. 7. In this embodiment, the electrodeposition apparatus 700 has a set of electroplating cells 707, each containing an electroplating bath, in a paired or multiple "duet" configuration. In addition to electroplating per se, the electrodeposition apparatus 700 may perform a variety of other electroplating related processes and sub-steps, such as spin-rinsing, spin-drying, metal and silicon wet etching, electroless deposition, pre-wetting and pre-chemical treating, reducing, annealing, photoresist stripping, and surface pre-activation, for example. In various embodiments, the electrodeposition apparatus 700 may include one or more modules configured to pre-treat the substrate to reduce or otherwise remove surface oxides present on the surface of the substrate (e.g., through exposure to hydrogen-containing plasma, or any of the other pre-treatments mentioned herein). The apparatus may or may not include a load lock suitable for transferring the substrate from the pre-treatment module to the electroplating module under vacuum. The electrodeposition apparatus 700 is shown schematically looking top down in FIG. 7, and only a single level or "floor" is revealed in the figure, but it is to be readily understood by one having ordinary skill in the art that such an apparatus, e.g., the Novellus Sabre™ 3D tool, can have two or more levels "stacked" on top of each other, each potentially having identical or different types of processing stations.

Referring once again to FIG. 7, the substrates 706 that are to be electroplated are generally fed to the electrodeposition apparatus 700 through a front end loading FOUP 701 and, in this example, are brought from the FOUP to the main substrate processing area of the electrodeposition apparatus 700 via a front-end robot 702 that can retract and move a substrate 706 driven by a spindle 703 in multiple dimensions from one station to another of the accessible stations-two front-end accessible stations 704 and also two front-end accessible stations 708 are shown in this example. The front-end accessible stations 704 and 708 may include, for example, pre-treatment stations, and spin rinse drying (SRD) stations. Lateral movement from side-to-side of the front-end robot 702 is accomplished utilizing robot track 702*a*. Each of the substrates 706 may be held by a cup/cone assembly (not shown) driven by a spindle 703 connected to a motor (not shown), and the motor may be attached to a mounting bracket 709. Also shown in this example are the four "duets" of electroplating cells 707, for a total of eight electroplating cells 707. A system controller (not shown) may be coupled to the electrodeposition apparatus 700 to control some or all of the properties of the electrodeposition apparatus 700. The system controller may be programmed or otherwise configured to execute instructions according to processes described earlier herein.

System Controller

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the delivery of processing gases, temperature settings (e.g., heating and/or cooling), pressure settings, vacuum settings, power settings, radio frequency (RF) generator settings, RF matching circuit settings, frequency settings, flow rate settings, fluid delivery settings, positional and operation settings, wafer transfers into and out of a tool and other transfer tools and/or load locks connected to or interfaced with a specific system.

In a particular example, the system controller may be configured to transfer the substrate, pre-treat the substrate, and electroplate the substrate as described in relation to FIG. 2. For instance, the system controller may be configured to immerse the substrate and measure the current and/or voltage response during and/or immediately following immersion. The system controller may also be configured to compare the current response at a target time to a threshold current. In some cases, the system controller may be configured to compare the voltage response at a target time to a threshold voltage. In some cases, the system controller may be configured to compare the time it takes for the voltage response to reach a target voltage to a threshold time. In some cases, the system controller may be configured to compare the time it takes for the current response to reach a target current to a threshold time. In some cases, the system controller may be configured to compare the maximum current response to a threshold maximum current. In some cases, the system controller may be configured to compare the maximum voltage response to a threshold maximum voltage. In some cases, the system controller may be configured to compare a current response integrated over a target timeframe to a threshold integrated current. In some cases, the system controller may be configured to compare a voltage response integrated over a target timeframe to a threshold integrated voltage. The various targets and thresholds may be selected based on the calibration procedures described herein, and may be chosen to distinguish between cases where surface oxide conditions are acceptable (e.g., little or no oxide) and cases where the surface oxide conditions are not acceptable (e.g., too much oxide for that particular application). In some cases, the system controller may be configured to determine whether oxide is still present on the substrate surface at a time during/after immersion, for example to determine when to apply an electrical signal to initiate electroplating. Similarly, the system controller may be configured to pre-treat substrates using different sets of pre-treatment conditions, as described in relation to FIG. 4. The system controller may be configured to immerse each substrate in electrolyte and measure the resulting current and/or voltage response, and to compare the current and/or voltage response to determine which sets of pre-treatment conditions were successful in adequately removing surface oxide.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

The various hardware and method embodiments described above may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility.

Lithographic patterning of a film typically comprises some or all of the following steps, each step enabled with a number of possible tools: (1) application of photoresist on a workpiece, e.g., a substrate having a silicon nitride film formed thereon, using a spin-on or spray-on tool; (2) curing of photoresist using a hot plate or furnace or other suitable curing tool; (3) exposing the photoresist to visible or UV or x-ray light with a tool such as a wafer stepper; (4) developing the resist so as to selectively remove resist and thereby pattern it using a tool such as a wet bench or a spray developer; (5) transferring the resist pattern into an underlying film or workpiece by using a dry or plasma-assisted etching tool; and (6) removing the resist using a tool such as an RF or microwave plasma resist stripper. In some embodiments, an ashable hard mask layer (such as an amorphous carbon layer) and another suitable hard mask (such as an antireflective layer) may be deposited prior to applying the photoresist.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above described processes may be changed.

The subject matter of the present disclosure includes all novel and nonobvious combinations and sub-combinations of the various processes, systems and configurations, and other features, functions, acts, and/or properties disclosed herein, as well as any and all equivalents thereof.

What is claimed is:

1. A method of selecting pre-treatment conditions for removing oxide from a surface of a production substrate, the method comprising:

(a) providing a plurality of calibration substrates;

(b) pre-treating at least some of the calibration substrates to at least partially remove oxide from a surface of each calibration substrate that is pre-treated, wherein the calibration substrates that are pre-treated are pre-treated using different sets of pre-treatment conditions;

(c) immersing each calibration substrate in an electrolyte after pre-treatment;

(d) measuring a voltage response or a current response during and/or immediately after each calibration substrate is immersed in the electrolyte;

(e) analyzing the voltage responses or current responses measured in (d) by comparison with substrates known to include oxide to identify which sets of pre-treatment conditions resulted in adequate removal of oxide from the surface of a relevant calibration substrate;

(f) selecting pre-treatment conditions for removing oxide from the surface of a production substrate based on the analysis of (e);

(g) pre-treating the production substrate for removing surface oxide based on the pre-treatment conditions selected in (f); and (h) electroplating the production substrate in an electroplating solution, wherein a composition of the electrolyte in which each calibration substrate is immersed is the same or substantially the same as the electroplating solution for the production substrate.

2. The method of claim 1, wherein at least one calibration substrate is not pre-treated.

3. The method of claim 1, wherein at least one calibration substrate includes an oxide layer purposely deposited thereon.

4. The method of claim 1, wherein at least one calibration substrate is not pre-treated, and wherein at least one calibration substrate is pre-treated to completely remove the oxide from its surface.

5. The method of claim 1, wherein a diameter of the calibration substrates does not substantially vary from a diameter of the production substrate, wherein a composition of a seed layer on the calibration substrates does not substantially vary from a composition of a seed layer on the production substrate, wherein a thickness of the seed layer on the calibration substrates does not substantially vary from a thickness of the seed layer on the production substrate, wherein a magnitude of a current and/or voltage applied to the calibration substrates during and/or shortly after immersion, if any, does not substantially vary from a magnitude of a current and/or voltage applied to the production substrate during and/or shortly after immersion, if any, wherein a vertical speed of immersion used to immerse the calibration substrates does not substantially vary from a vertical speed of immersion used to immerse the production substrate, wherein a tilt angle and tilt speed used to immerse the calibration substrates does not substantially vary from a tilt angle and tilt speed used to immerse the production substrate, and wherein a rate of rotation used to spin the calibration substrates during immersion does not substantially vary from a rate of rotation used to spin the production substrate during immersion.

6. The method of claim 1, wherein during (c), the current applied to each calibration substrate is controlled, and wherein during (d), the voltage response is measured.

7. The method of claim 1, wherein during (c), the voltage applied to each calibration substrate is controlled, and wherein during (d), the current response is measured.

8. The method of claim 1, wherein pre-treating at least some of the calibration substrates includes exposing the calibration substrates to plasma, wherein the calibration substrates that are pre-treated are pre-treated using different sets of plasma pre-treatment conditions.

* * * * *